US007004916B2

(12) United States Patent
Dehli

(10) Patent No.: US 7,004,916 B2
(45) **Date of Patent: *Feb. 28, 2006**

(54) MASSAGING DEVICE FOR CHAIRS WITH GUIDE RAIL AND CARRIAGE ASSEMBLY

(75) Inventor: Hans Dehli, Dana Point, CA (US)

(73) Assignee: Interactive Health, LLC, Long Beach, CA (US)

( * ) Notice: Subject to any disclaimer, the term of this patent is extended or adjusted under 35 U.S.C. 154(b) by 20 days.

This patent is subject to a terminal disclaimer.

(21) Appl. No.: 10/045,995

(22) Filed: Oct. 19, 2001

(65) Prior Publication Data

US 2002/0082533 A1 Jun. 27, 2002

Related U.S. Application Data

(63) Continuation-in-part of application No. 09/632,315, filed on Aug. 4, 2000, now Pat. No. 6,814,710.

(60) Provisional application No. 60/148,929, filed on Aug. 5, 1999.

(51) Int. Cl.
*A61H 15/00* (2006.01)

(52) U.S. Cl. ..... 601/99; 601/100; 601/101; 601/102; 601/116

(58) Field of Classification Search ..... 601/86, 601/87, 90, 93, 94, 95, 98–103, 116; 193/37, 193/35 B; 104/242, 244, 245, 246; 105/30; 233/127–9; 295/1, 8; 212/198
See application file for complete search history.

(56) References Cited

U.S. PATENT DOCUMENTS 2,884,923 A * 5/1959 Buffalow ..... 601/116

(Continued)

FOREIGN PATENT DOCUMENTS

| | | |
|---|---|---|
| DE | 29814918 U1 | 1/1999 |
| DE | 29901496 U1 | 7/1999 |
| WO | WO99/56694 | 11/1999 |

OTHER PUBLICATIONS

European Search Report for Application No. 00952596.5 dated Jan. 20, 2005, 5 pages.

*Primary Examiner*—Danton DeMille

(74) *Attorney, Agent, or Firm*—Christie, Parker & Hale, LLP.

(57) ABSTRACT

An adjustable massaging device includes a track comprising two rails formed on a support structure. The device includes a carriage assembly that causes a massaging unit comprising a pair of massaging members to move back and forth along the rails on the support structure. The massaging members are mounted to a rotatable shaft in such a fashion as to perform a finger pressure-like massage or a tapping massage on the interior of the massaging surface, such that a user may be massaged by contacting the exterior of the massaging surface. The adjustable massaging device may be used in the back of a chair, for example, to massage a user's back. The support structure on which the massaging unit is formed is adjustable within the chair such that, in a retracted position, the massaging members are distanced from the massaging surface and the chair may be used as a standard office chair without any massaging parts contacting the massaging surface. In a number of deployed or massaging positions, the massaging members are in contact with the interior of the massaging surface and are capable of exerting various massage pressures. The support structure may be hinged to a bracket and pivotally movable with respect to the bracket by a handle or motorized means.

28 Claims, 26 Drawing Sheets

U.S. PATENT DOCUMENTS 3,389,699 A * 6/1968 Mathers ..... 601/52
3,633,571 A 1/1972 Shinagawa et al.
3,661,431 A 5/1972 Wisecarver
3,854,165 A 12/1974 Haley
4,016,872 A 4/1977 Yamamura et al.
4,171,670 A 10/1979 Roberts
4,422,449 A 12/1983 Hamabe
4,574,786 A 3/1986 Hashimoto et al.
4,576,149 A 3/1986 Otuka et al.
4,586,493 A 5/1986 Goodman
5,022,386 A 6/1991 Kuniskis
5,373,791 A 12/1994 Bach et al.
5,464,382 A 11/1995 Wang
5,618,262 A * 4/1997 Rene ..... 601/116
5,755,677 A 5/1998 Masuda et al.
5,792,080 A 8/1998 Ookawa et al.
6,117,094 A 9/2000 Fujii
6,213,962 B1 4/2001 Shimizu
6,485,443 B1 * 11/2002 Garth ..... 601/98

* cited by examiner 311
300
32
116
309
33
308
300
333

32
116
308
300
333
311
300
309
33

307
329
300
32
315
303
313
309
305
311
299
300
308
309
300

MASSAGING DEVICE FOR CHAIRS WITH GUIDE RAIL AND CARRIAGE ASSEMBLY

CROSS-REFERENCE TO RELATED APPLICATION

This application is a continuation-in-part of patent application 09/632,315 filed on Aug. 4, 2000 now U.S. Pat. No. 6,814,710 and which claims the benefit of U.S. Provisional Application No. 60/148, 929, filed Aug. 5, 1999, the disclosures of each of which are hereby incorporated by reference.

FIELD OF THE INVENTION

The present invention relates to massaging devices, and more particularly, to massaging devices utilizing a greaseless rail system, and/or non-rotary massaging members.

BACKGROUND OF THE INVENTION

Certain custom-built massaging chairs known in the art include a massaging device for performing massaging functions. One type of massaging device is shown in PCT International Application No. PCT/JP99/01340, filed Mar. 17, 1999, by Shimizu Nobuzo. The massaging device used in such chairs includes a track, a massage wheel driving mechanism slidably coupled to the track, and a pair of rotating massage wheels, which are attached to the drive mechanism and translated along the track. The track forms two C-shaped rails. One or more guide wheels having a generally flat circumferential surface are coupled to each side of the driving mechanism. The wheels on each side of the mechanism are fitted within a corresponding rail. Grease is typically applied within the rails to reduce friction between the wheel sides and the rails. The driving mechanism is electrically coupled via electrical wires to a controller that provides the appropriate signal to a motor for driving the mechanism back and forth along the rails. The controller is coupled to a selection device for allowing the user of the massaging chair to turn the motor on and off and to select the speed of the movement of the massaging wheels. The driving mechanism generally includes a limit switch, which controls the motion of the driving mechanism along the rails.

Each massaging wheel is coupled to the driving mechanism about a rotary shaft. The massage wheels are mounted to the rotary shaft eccentrically, and in an oblique fashion relative to the spin axis of the shaft. A second motor rotates the massaging wheels. The wheels are mounted eccentrically and obliquely relative to the spin axis, allowing the outer-peripherals of the massaging wheels to move from side-to-side in a reciprocating fashion. As the driving mechanism travels along the rails, it enables the massaging wheels to translate longitudinally, while the motor causes the wheels to simultaneously move back and forth sideways.

The massaging device is typically located in the back of the chair, with the rails running vertically along the back of the chair and with the massaging wheels making contact with the fabric on the front face of the chair. Thus, the user sitting in the chair comes in indirect contact with the massaging wheels. Typically, the massaging device is centered along the back of the chair so as to straddle the spine of the user. As the driving mechanism rides up and down along the rails, the massaging wheels massage the user's back as they move longitudinally and sideways along the back of the chair.

A problem with existing massaging devices is that with time, wear of the guide wheels causes the guide wheels to rattle within the rails during operation, which may result in an annoying clattering sound. In addition, current massaging devices are often wearing on the chair fabric. As the massaging wheels translate longitudinally along the length of the chair, the wheels' sidewards motion exerts lateral frictional forces on the fibers of the chair's fabric, causing the fibers to tear over time. In a similar fashion, wheel rotation exerts longitudinal forces on the fabric, which also tends to abrade or tear the fabric over a period of time.

Current massaging devices are also hazardous. As the rotating wheels move from side-to-side, the outer-periphery of the wheels rotate in close proximity to the drive motor, creating a pocket whereby objects may be crimped. Because of the compliant characteristics of the chair fabric that is interposed between the user and the massage wheels, the user's limbs or parts of their flesh may be pinched within the pocket, creating a potential hazzard.

Existing massaging devices also do not adequately protect the wiring that sends signals and provides the power to drive the driving mechanism from becoming tangled and chaffed from the movement of the driving mechanism. Tangled and chaffed wires may result in failure of the massaging device and sometimes in hazardous conditions such as the initiation of a fire. Moreover, the driving mechanism limit switches in these devices are openly exposed, leading to the risk of damage or misalignment, either of which may result in subsequent malfunction or damage to the massage mechanism.

Another problem inherent in conventional massaging devices that use grease to induce smooth travel of the guide wheels within the rails, is that the grease can escape the rails and stain the chair. Grease also accumulates dirt and dust, which deteriorates the performance of the massaging device over time. Additionally, current massaging devices are bulky in size and weight. The bulky profile of current massage devices require massage chairs using these devices to grow in size and weight, making it difficult to incorporate the device into chairs having small profiles, such as the bucket seats of cars and aircraft.

Moreover, current messaging devices incorporated within reclining chairs are not modular. When the messaging device requires maintenance, either a technician is required to service the reclining unit at the customer's residence, or the reclining chair, as a unit, must be transported to the service center. Thus, servicing current messaging units can be costly and inconvenient.

What is needed, therefore is a massaging device that preferably does not rattle with age, does not wear away the chair fabric at a considerable rate, and is safe to the user. Such a device preferably provides protection to the wiring between the driving mechanism and the controller against chaffing, provides protection to the driving mechanism limit switches to prevent switch damage or misalignment, and is more compact than current massaging devices. Further, such device is modular, providing convenient and inexpensive maintenance.

SUMMARY OF THE INVENTION

The present invention provides, in one embodiment, a massaging device having a track comprising two rails formed on a support structure. The device also includes a driving mechanism that causes a massaging unit comprising a pair of massaging members to move back and forth along the rails of the support structure.

In one embodiment, a threaded guide rod, rotatably attached to a drive motor, is incorporated in the track and spans the length of the track. The guide rod engages a cylindrical member coupled to the driving mechanism so as to translate the driving mechanism along the rod as the rod is rotated. A controller, which receives signals from a user control or remote control, controls the translation of the driving mechanism and massaging device.

The massaging device according to the present invention is modular and may be incorporated in various types of massaging apparatuses such as a massaging chair, or a stand-alone one piece casing that may be leaned against a wall or the back of a chair.

In another embodiment, the massaging device is adjustable when incorporated into various types of massaging apparatuses. According to this embodiment, the massaging unit is driveable along the massaging plane defined by the rails set into position on a support structure. The support structure is pivotally attached to a bracket which is fixedly coupled within the massaging apparatus. The massaging apparatus may preferably include a compliant massaging surface for a user's body part to rest against. A handle or motor provides for adjustability of the support structure with respect to the bracket and the massaging surface. The support structure and therefore the massaging plane is adjustable with respect to the bracket and the massaging surface. The adjustment mechanism may include cams, sets of pivotally coupled links or other mechanical components. The massaging device can be adjusted to a number of deployed positions, in which the massaging members contact the inside of the massaging surface thereby massaging the user's body part. The massaging device may also be retracted to remove the massaging members from the massaging surface. In an exemplary embodiment, the massaging apparatus may be a chair with the user's back resting on the compliant massage surface and in which the chair may function as a standard office chair when the massaging members are retracted.

In further embodiments, the massaging device is hand-carriable, wherein the massaging unit is housed within a simple casing instead of traveling along a track.

The present invention may readily retrofit existing recliners. The invention's improved size and weight provides advantages over massaging devices of the prior art. The present invention's greaseless operation and durable construction provides additional advantages over the prior art. Further, the massaging members of the present invention are configured such that they do not rotate in close proximity to the structure of the massaging unit. Accordingly, fingers or other body parts will not become pinched between the support frame of the massaging unit and the massaging members.

DESCRIPTION OF THE DRAWINGS

These and other features and advantages of the present invention will be better understood by reference to the following detailed description when considered in conjunction with the accompanying drawings wherein.

Like numerous denote like elements throughout the specification and figures.

DETAILED DESCRIPTION OF THE INVENTION

Figure 1:
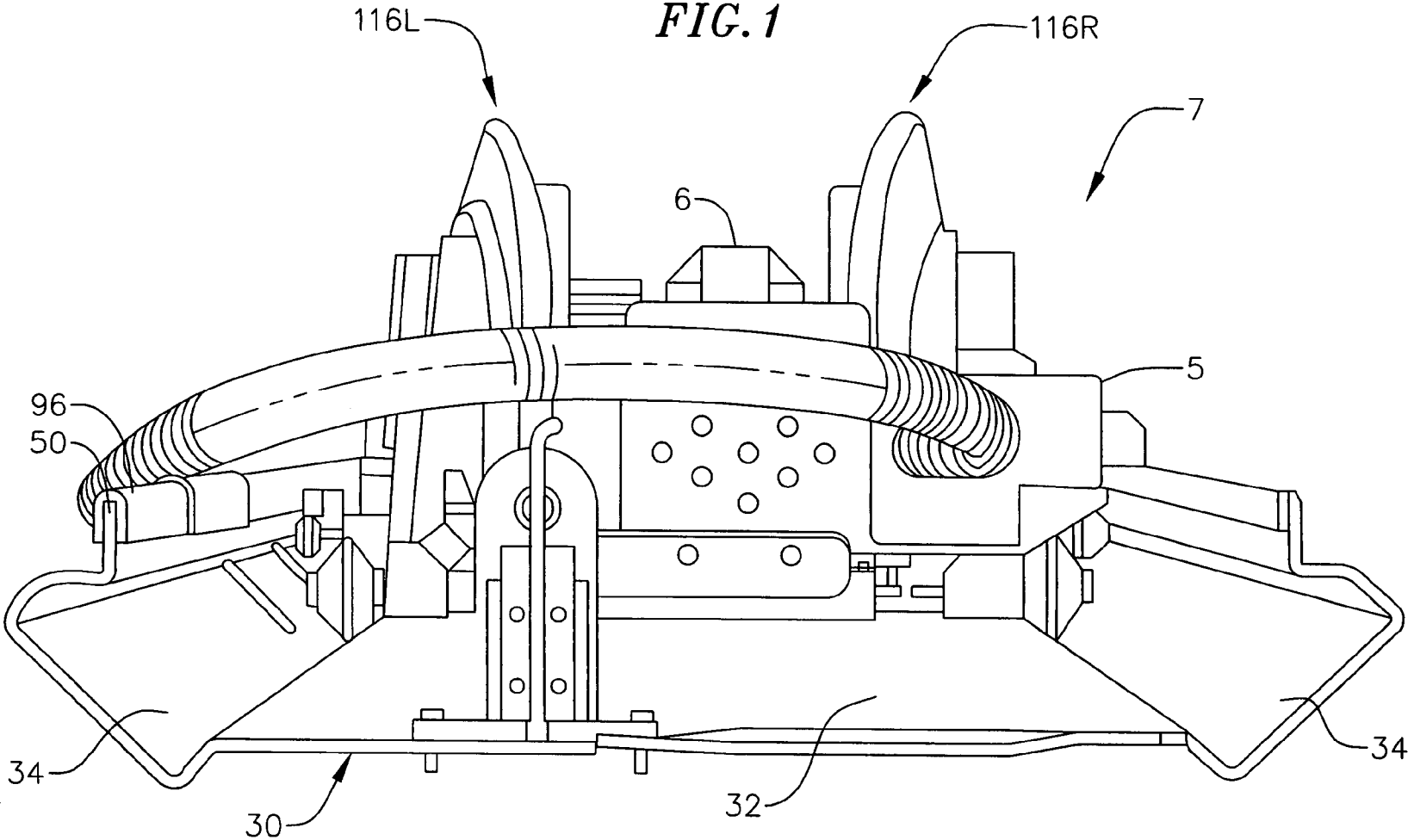
FIG. 1 is a front view of a massaging device of the present invention.

Referring to FIG. 1, in a preferred embodiment of the invention, a massaging device 7 includes a track comprising two rails. The massaging device 7 also includes a driving mechanism 5 that causes a massaging unit 6 comprising a pair of massaging members 116R, 116L to move back and forth along the rails. Preferably, the rails are part of a unitary track structure 30 comprising a support structure 32 having proximal and distal ends 250 and 260 (see FIG. 5), and rails 34 formed on opposite sides of the support structure 32. Because both rails are preferably identical, only one of the rails is described herein for convenience.

Figure 2:
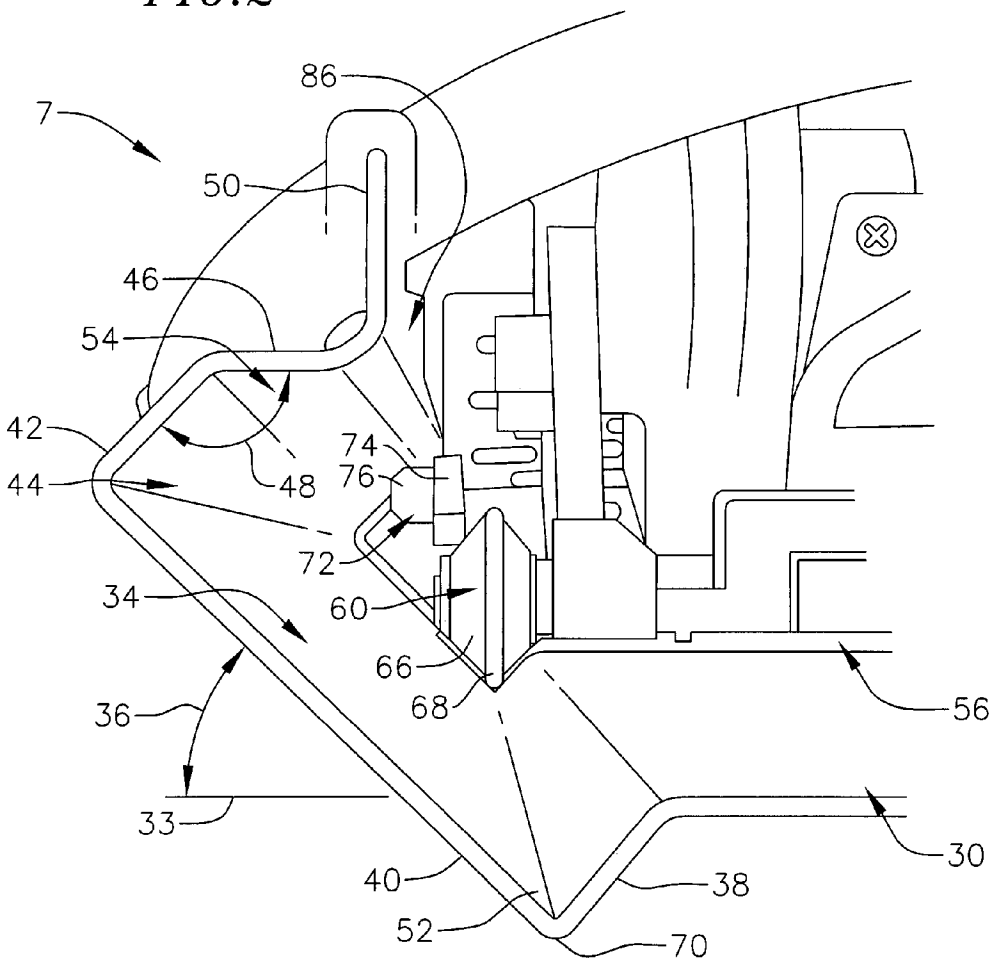
FIG. 2 is a enlarged partial front view of the massaging device shown in FIG. 1.

Referring to FIG. 2, the rail 34 comprises a channel shaped cross-section and is positioned at an acute angle 36 relative to the plane 33 of movement of the driving mechanism 5. The rail 34 has a first leg 38 spanning the length of the rail 34. From the first leg 38 extends a web 40 that spans the length of the rail 34. The web 40 is preferably perpendicular to the first leg 38. A second leg 42 extends perpendicularly from the web 40 opposite the first leg 38 whereby the first leg 38, the web 40 and the second leg 42 define a channel 44. A first lip portion 46 extends from the second leg 42 at an obtuse angle 48 towards the first leg 38. The first lip portion 46 spans the length of the rail 34. A second lip portion 50 extends from the first lip portion, spanning the length of the rail 34. The second lip 50 preferably extends at an angle such that it is perpendicular to the plane of movement 33 of the driving mechanism 5.

A first raceway 52 is defined in the rail 34 between the first leg 38 and the web 40. Because of the angle 36 of extension of the rail 34 relative to the plane 33 of movement of the driving mechanism 5, the first raceway 52 is V-shaped in cross-section when viewed from an end of the massaging device 7. A second raceway 54 is defined on the inner surface of the first lip portion 46. Each rail 34 is preferably formed from a single sheet of material, for example, by bending a single sheet of metal. In the preferred embodiment shown in FIGS. 1 and 2, the entire track 30 is formed from a single sheet of metal. In alternative embodiments, the track 30, may comprise injection molded polished plastics such as delrin, Teflon and the like. In other embodiments, the track 30 may comprise ceramic materials having polished surfaces and high tensile strengths. In another embodiment, the two rails 34 can be separate structures that are interconnected defining a track 30.

Figure 3:
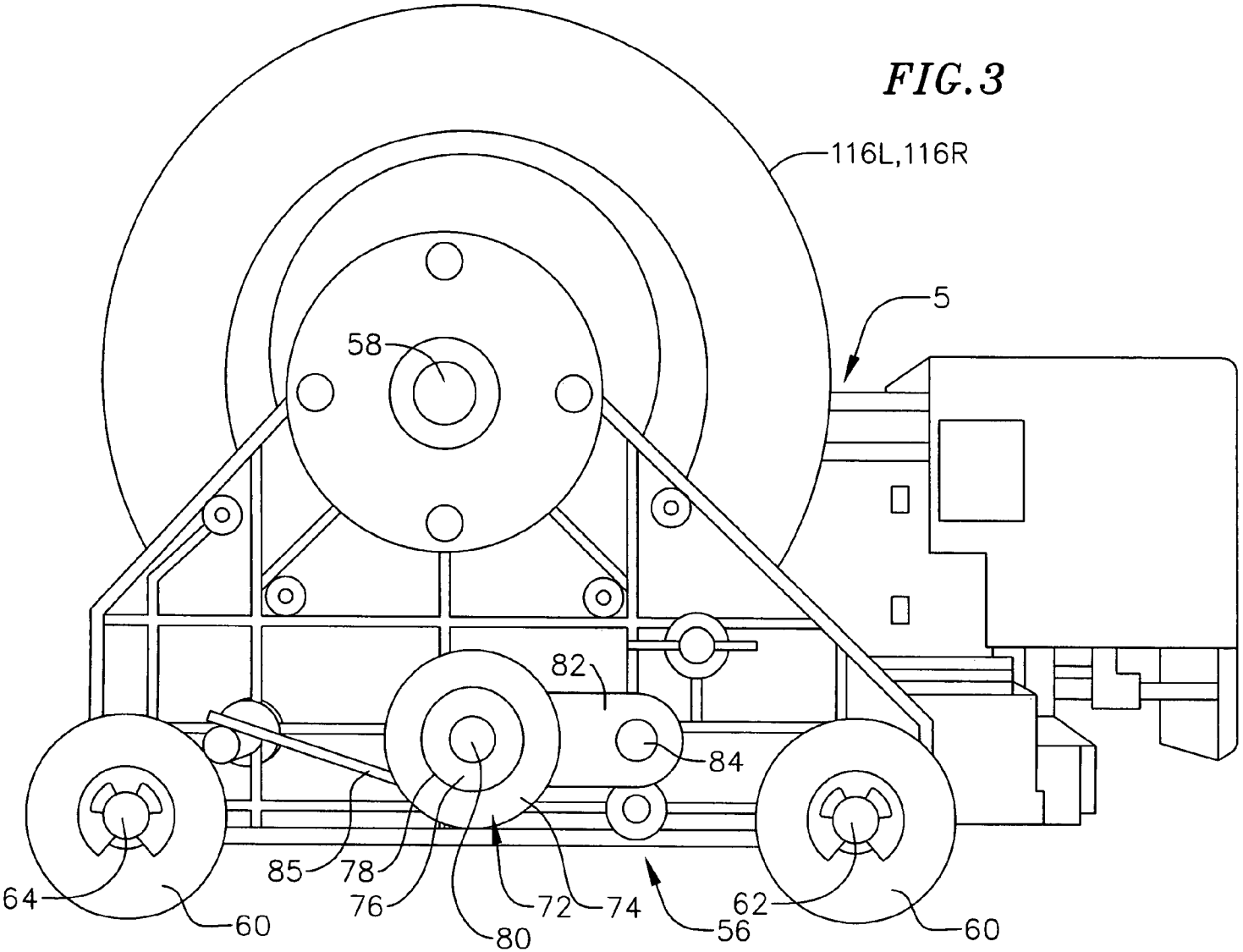
FIG. 3 is a side view of the driving mechanism of the massaging device of the present invention.

Referring to FIG. 3, the driving mechanism 5 comprises a carriage 56. The carriage 56 supports an axle 58 onto which are mounted the massaging members 116L,116R. Preferably, a set of guide wheels 60 extend from each side of the carriage 56. Corresponding wheels 60 on each side of the carriage 56 may be coupled to the same axle. For example, in the preferred embodiment, one set of wheels 60 is coupled to a first axle 62 and another set of wheels 60 is coupled to a second axle 64. In an alternate embodiment, a separate axle may be provided for each wheel 60.

Figure 4:
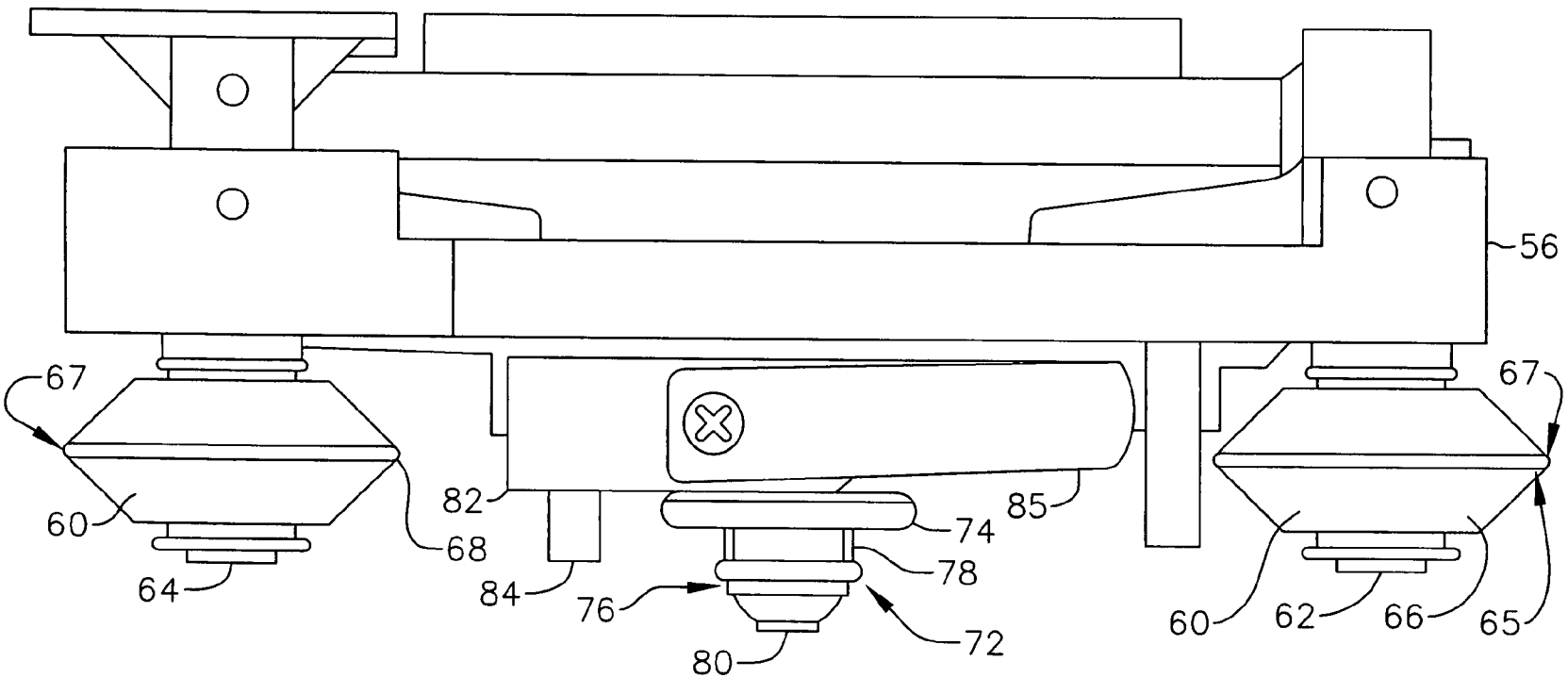
FIG. 4 is a bottom view of a side end of the driving mechanism shown in FIG. 3.

Referring to FIG. 4, each guide wheel 60 has a sidewall surface 66 which tapers inward such that each guide wheel 60 has a generally diamond shaped cross-section. An annular groove 65 formed along a vertex 67 of each guide wheel 60 accommodates an O-ring 68 preferably made from rubber or other similar material.

As illustrated in FIG. 2, the tapering of the sidewalls 66 is such that each wheel 60 can be mated to the first raceway 52 of each rail 34. As such, the rubber or rubber-like O-ring 68 rides at the vertex 70 of the first raceway 52. Each guide wheel 60 is preferably double molded with its interior molded from nylon, and its exterior (or overmold) molded from urethane. The nylon center acts as the bearing bushing that fits over a guide wheel axle 62,64 (FIG. 6) whereas the softer urethane outer surface serves to increase grip and significantly reduce vibrations and noise as the wheels 60 travel along the rails 34.

Referring now to FIGS. 3 and 4, a biasing wheel 72 is coupled on either side of the carriage 56. Preferably each biasing wheel 72 is positioned between the two guide wheels 60 on either side of the carriage 56. Preferably, each biasing wheel 72 comprises a first larger diameter section 74 and second smaller diameter section 76. The second smaller diameter section 74 extends axially and concentrically from the first section 74. Because of its function, the biasing wheel 72 preferably comprises a bearing material, such as Nylon, Delrin, Teflon or other materials having similar mechanical properties. In preferred embodiments, the second section 74 is overmolded with rubber or a rubber-like material 78, such as urethane. In alternative embodiments, a rubber or rubber like O-ring is fitted within an annular groove formed along the circumferential surface of the second section 74 of each biasing wheel 76.

Each biasing wheel 72 is mounted on an axle 80 which is perpendicularly mounted on a pivoting arm 82. The pivoting arm 82 is pivotally coupled to a side of the carriage 56 via an axle 84, and is spring loaded in a direction away from the guide wheels 60. This may be accomplished using a torsion spring assembly 85 coupled to the pivoting arm 82 and carriage 56 in surrounding relationship with the axle 84. Alternatively, an axial spring (not shown) may be used that is coupled to the carriage 56 and transversely to the pivoting arm 82 for biasing the pivoting arm 82 in a direction away from the guide wheels 60. Other spring mechanisms are known in the art and may also be used.

As described in FIG. 2, the carriage 56, with massaging unit 6, is slidably coupled within the track 30 such that the guide wheels 60 are fitted within the corresponding first raceway 52 of each rail 34 while the second section 76 of each biasing wheel 72 is biased by the spring loaded arm 82 into a position bearing against the second raceway 54 of its corresponding rail 34. The first section 74 of each biasing wheel 72 bears against the inner surface 86 of second lip 50 of its corresponding rail 34, providing secondary alignment of the carriage 56 along the rail 34. The biasing wheels 72 are biased in a direction opposite the location of the guide wheels 60 to insure that the carriage 56 is maintained within the rails 34. By being spring loaded, the biasing arm 82 always biases the biasing wheel 72 against the second raceway 54, thereby taking up any slack that would otherwise form due to wear of the guide and biasing wheels. Consequently, the biasing wheels 72 are self-adjusting, taking up all the slack caused by wheel wear and alleviating the rattling that results from such slack. In addition, the use of the rubber or rubber-like O-rings on the guide wheels 60 serves to reduce vibration and noises as the carriage 56 rides along the track 30. This type of vibration is further reduced by the use of a softer material such as urethane to form the outer surfaces of the guide wheels 60 as described above. Moreover, the tapered guide wheels 60, i.e., guide wheels that have a generally diamond shaped cross-section, riding in a V-shaped raceway provide sideways containment of the massage carriage 56 without the need to use lubricants, as opposed to the conventional C-profile, which need lubrication due to the requirement for tight tolerances.

In alternative embodiments, the carriage 56 may be outfitted with more than one biasing wheel 72 on either side.

Moreover, one or more guide wheels 60 may be used on either side of the carriage 56. Furthermore, each biasing wheel 72 may only comprise a section that rides on the second raceway 54 of a rail 34. In such case, a second lip 50 need not be formed on the rails 34.

Figure 5:
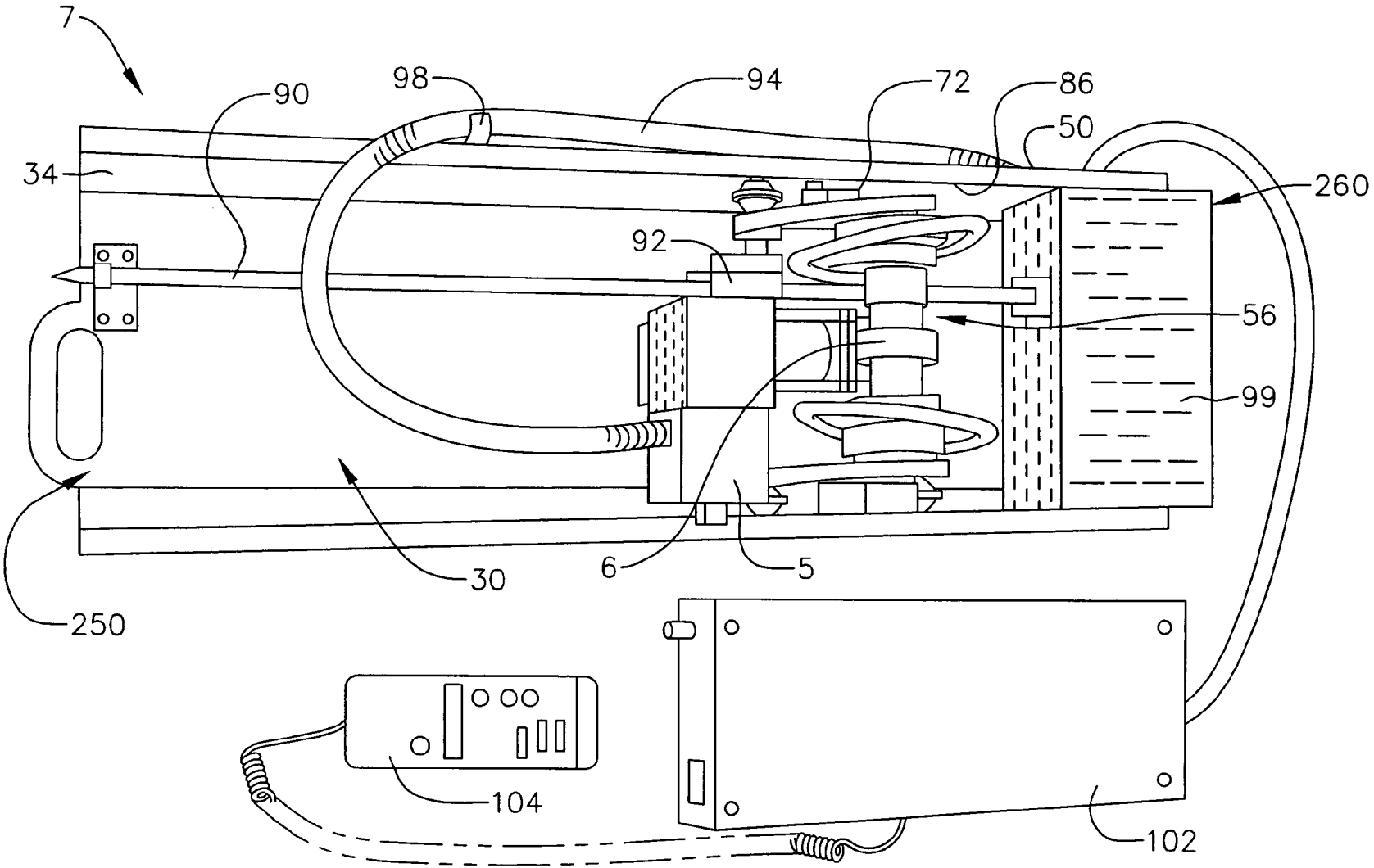
FIG. 5 is a top view of a massaging device of the present invention.

Referring to FIG. 5, a guide rod 90 is preferably incorporated in the track 30, spanning the length of the track 30. A cylindrical member 92 coupled to the driving mechanism 5 fits over the rod 90 such that the rod 90 penetrates the cylindrical member 92. In this regard, the rod 90 also serves to guide the driving mechanism 5 of massaging unit 6 along the track 30. The guide rod 90 has a threaded outer surface while the cylindrical member 92 has a threaded inner surface mating with the outer surface of the guide rod 90. In one embodiment, the guide rod 90 is rotatably attached to a drive motor (not shown), which causes the guide rod 90 to rotate and thread through the cylindrical member 92 so as to move the driving mechanism 5 along the rod 90. By reversing the rotation of the guide rod 90, the driving mechanism's 5 path is reversed. In another embodiment, a motor attached to the driving mechanism 5 causes the cylindrical member 92 to rotate, threading the rod 90 so as to move the driving mechanism 5 along the rod. In a further embodiment, the driving mechanism 5 can drive the guide wheels for translation along the track 30.

To prevent damage to wires providing signals and power to the driving mechanism 5, a flexible conduit 94 is used for harnessing and protecting the wires. To protect the conduit from wearing against the rail edge during movement of the driving mechanism 5, a plastic or rubber-like cover 96 (FIG. 1) is placed over the edge of the second lip 50 of the rail 34 over which the conduit 94 is routed. The cover 96 spans a portion of the second lip 50 length proximate the location of the conduit 94. In embodiments utilizing biasing wheels 72, wherein the first section 74 of the biasing wheel 72 bears against the inner surface 86 of the second lip 50, the cover 96 height is preferably limited to prevent interference with the travel of the biasing wheel 72. In alternative embodiments, clips 98 may be formed or attached on the rail 34 for retaining the conduit 94 close to the rail 34.

To protect the limit switches of the massaging device 7, the present invention incorporates a cover 99 to protect them from damage and misalignment.

The present invention also includes a controller 102 that is coupled to the driving mechanism 5. The controller 102 receives signals from a user control or a remote control 104 for controlling the operation of the massaging device 12.

Figure 6:
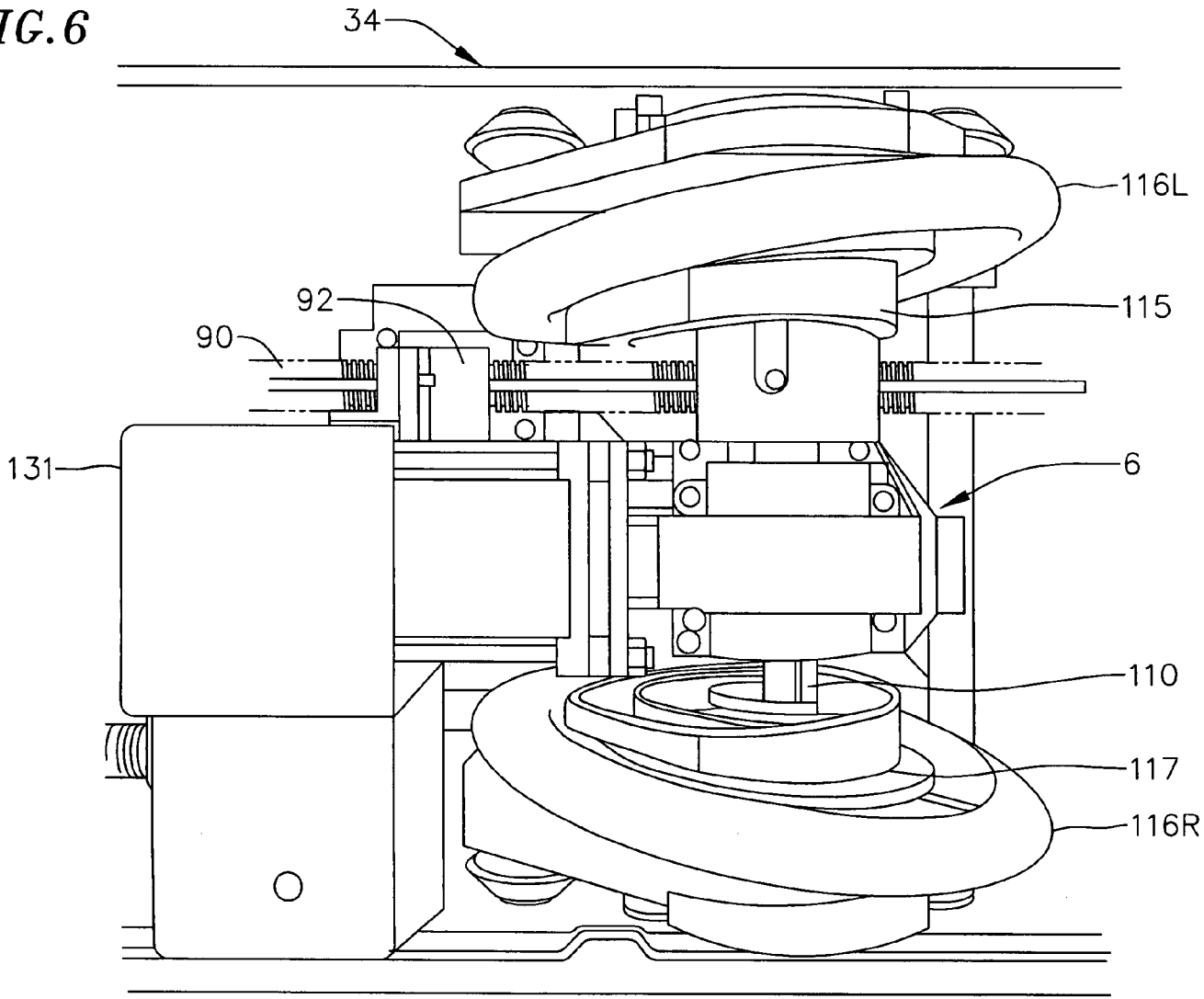
FIG. 6 is a partial top view of the driving mechanism installed on the massaging device of the present invention.

Referring to FIG. 6, the massaging unit 6 comprises right and left massaging members 116R, 116L. The right and left massaging members 116R, 116L include respective boss portions 115 which are mounted on and rotate with a shaft 110. The massaging members 116R, 116L are rotatably coupled to the boss portions 115 along on oblique axis 117, where the boss portion can rotate relative the massaging members 116R, 116L and wherein the massaging members 116R, 116L are eccentrically coupled to the shaft 110. The massaging members 116R,116L are held by the corresponding boss portions 115 as slanted relative to the axis of the rotary shaft 110.

Figure 7:
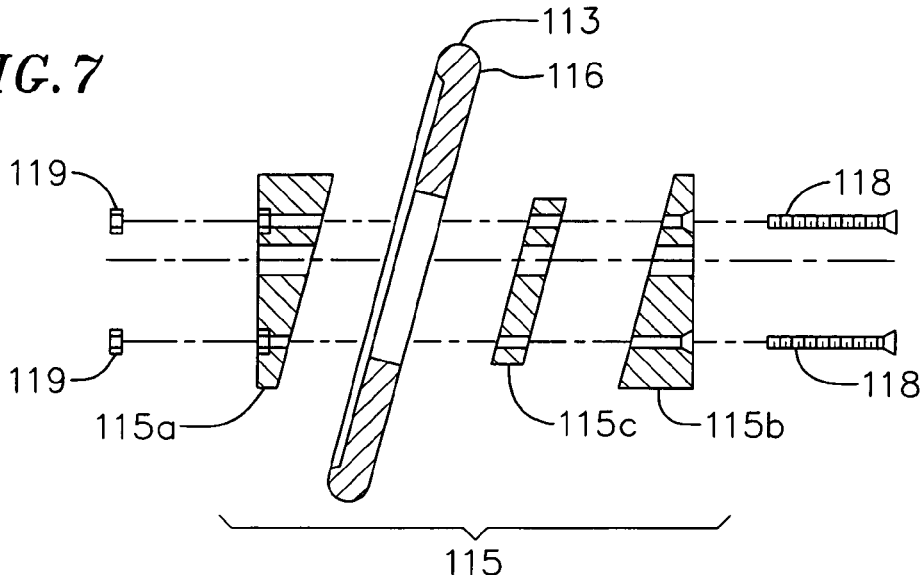
FIG. 7 is an exploded view of a massaging member assembly incorporated in the carriage shown in FIG. 6.

As shown in FIG. 7, each of the boss portions 115 includes a pair of sandwiching plates 115*a* and 115*b*, each in the form of a section of a cylinder sectioned askew relative to the axis of the cylinder, and a central plate 115*c* interposed between the sandwiching plates 115*a* and 115*b*. The central plate 115*c* is a shaped discoid with its opposite sides respectively abutting the slanted end faces of the sandwiching plates 115*a* and 115*b*. The plates 115*a*, 115*b* and 115*c* attach to the massaging member 116 by placing the sandwiching plates 115*a* and 115*b* on opposite sides of the massaging member 116, while the massaging member 116 centrally receives the central plate 115*c*. The plates 115*a*, 115*b* and 115*c* are fastened to the messaging member with bolts 118 which extend through the three plates and nuts 119. In one embodiment, the central plate 115*c* is formed integrally with one of the sandwiching plates 115*a* and 115*b*. Alternatively, the central plate 115*c* may comprise mating halves, having half the thickness of the plate 115*c*, formed integrally with the sandwiching plates 115*a* and 115*b*, respectively.

Figure 8A:
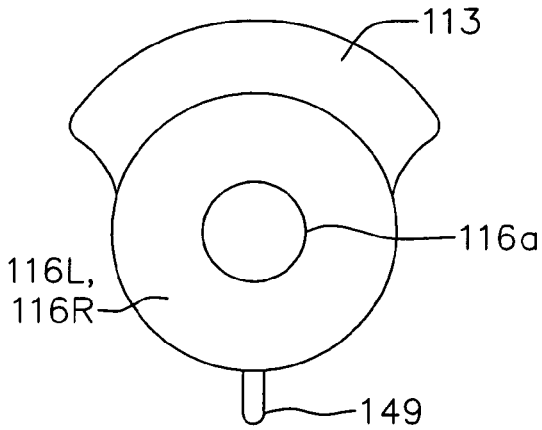
FIGS. 8A and 8B are front and side views of an embodiment of the massaging member according to the present invention.
Figure 8B:
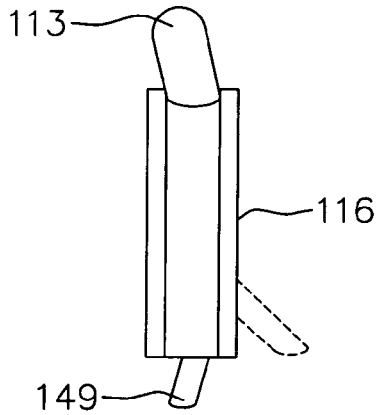

As depicted in FIGS. 8A and 8B, the massaging members 116R,116L are each partially discoid in shape, comprising a lobe 113 having a substantially radial cross-section and extending from a central portion of the member 116R, 116L. The massaging members 116R,116L also include a central hole 116*a* in the central portion thereof for slidably receiving the central plate 115*c* for rotation relative to the central plate 115*c*. Thus, the massaging members 116R,116L are rotatably coupled to the rotary shaft 110 being slanted relative to the axis of the rotary shaft 110. The massaging members 116R,116L are designed such that the lobes 113 travel in a reciprocal, sidewards motion. Thus, the present invention alleviates potential hazards to the user of pinching flesh between rotating massaging members and the structure of the massage unit. Further, the partial discoid shape of the massaging members 116R, 116L provides the massaging unit 6 with a thinner profile than rotating message wheels of the prior art, as only the portion of the massaging member 116 that contacts the affected part of the user requires a larger peripheral.

Figure 9B:
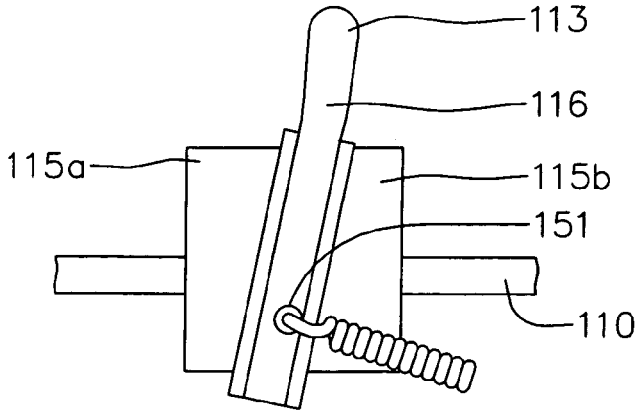
FIGS. 9A and 9B are enlarged partial perspective views of preferred and alternate embodiments of the retaining apparatus incorporated in the embodiments shown in FIG. 8.
Figure 9A:
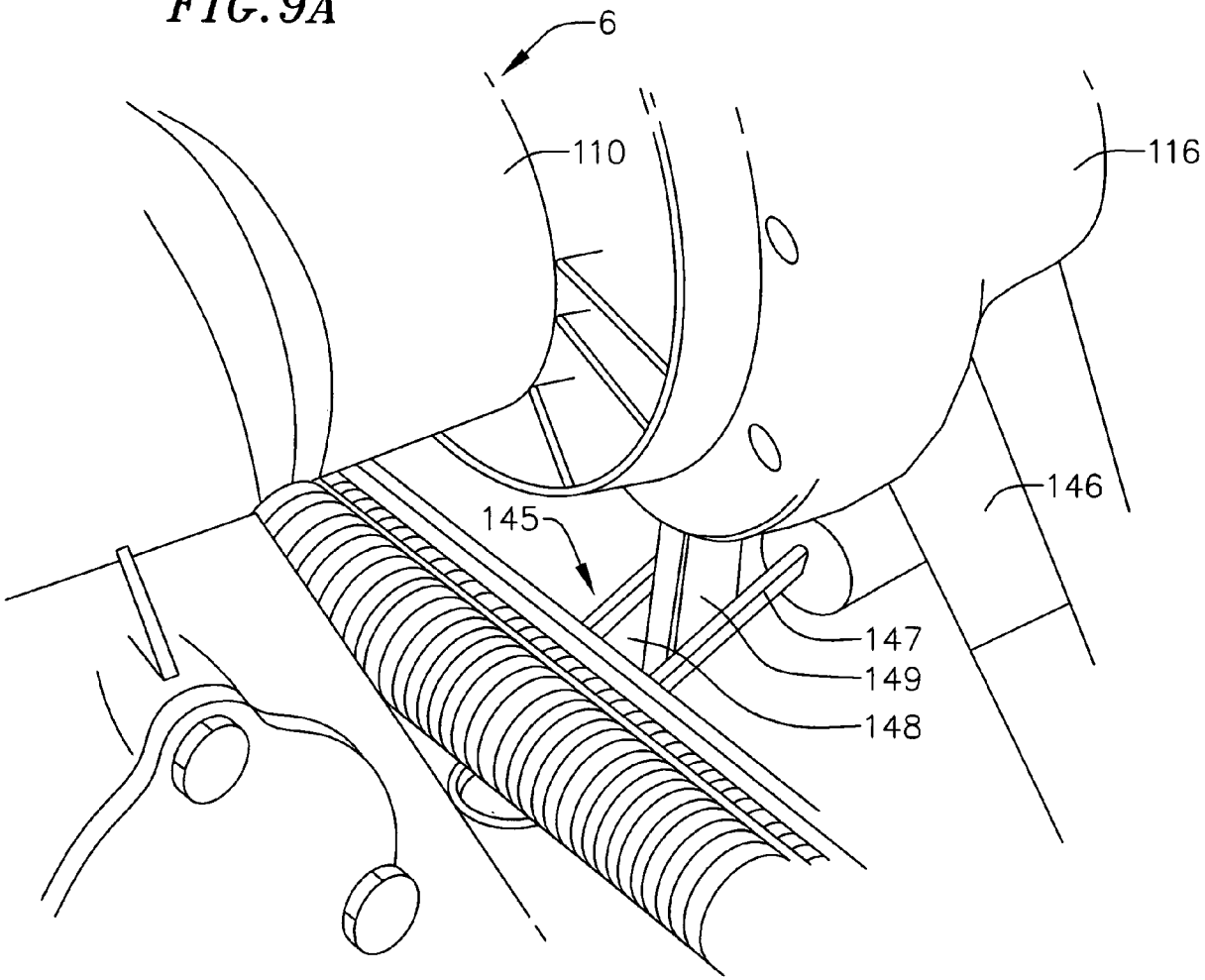

The massaging members 116R, 116L are preferably made of a polished plastic, such as Delrin, Teflon or the like. The polished plastic composition provides smooth contact between the massaging members 116R,116L and covering fabric. The smooth contact reduces the friction between the fabric and massaging members 116R,116L, and thus, reduces wear on the fabric. As shown in FIG. 9A, a retaining apparatus 145 extending from a support frame 146 of the massaging unit 6 just beneath the massaging member 116R, 116L is used to constrain the motion of messaging members 116R, 116L to a reciprocal, side-to-side motion. The retaining apparatus 145 comprises a U-shaped retaining bar 147 forming a slot 148 in-line with the axis of the rotary shaft 110. A protruding, bar shaped element 149 formed at a base portion of the massaging members 116R, 116L, slidably engages the slot 148, restricting the massaging members 116R,116L from continuous rotation with the rotary shaft 110, and limiting the movement of the members 116R,116L to an oscillating sidewards motion. Preferably, the protruding element 149 extends from the side of the massaging members 116R,116L to aid in further reducing the massaging unit 6 profile. In an alternate embodiment, as shown in FIG. 9B, a tension spring, coupled to the support frame 146 and a peg 151 located along a base portion of the massaging members 116R,116L, may be used to limit the members 116R,116L from rotating with the rotary shaft 110.

Figure 10:
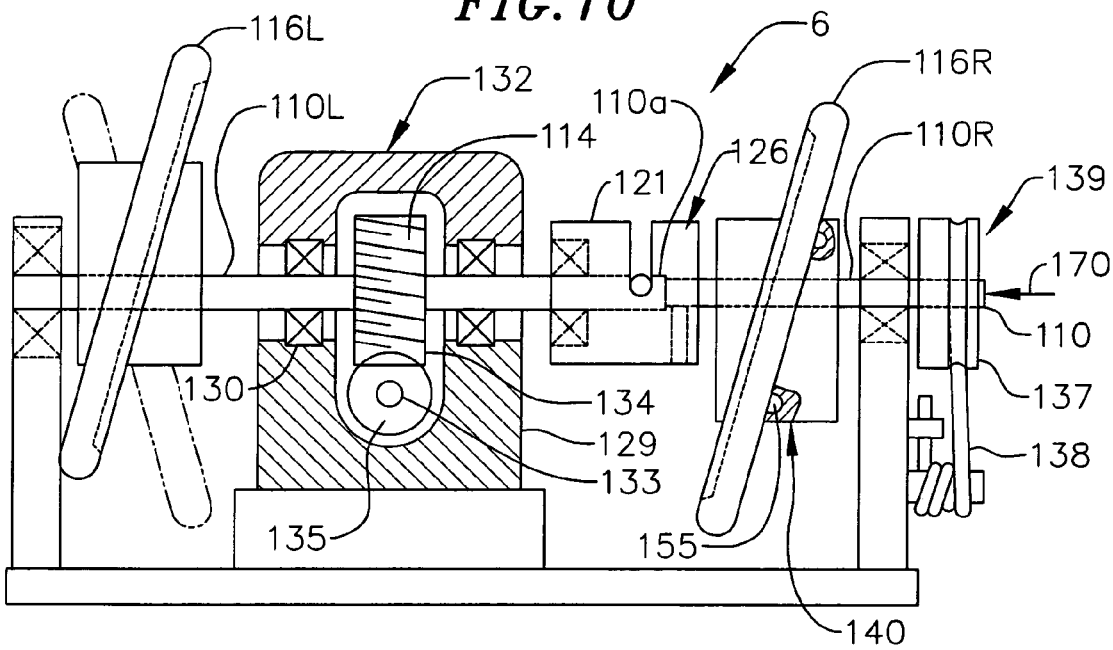
FIG. 10 is an end view of an alternate embodiment of a massaging device carriage assembly according to the present invention.

In a preferred embodiment, as shown in FIG. 6, a separate motor 131 drives the rotary shaft 110, and actuates the massaging members 116R, 116L, while the guide rod 90 and internally threaded cylindrical member 92 move the entire mechanism 5 to a different location along the rails 34. Referring to FIG. 10, the rotary shaft 110 includes a first shaft portion 110L supporting the left massaging member 116L, and a second shaft portion 110R supporting the right massaging member 116R. The second shaft portion 110R is coaxially aligned with the first shaft portion 110L. The first shaft portion 110L comprises a portion for mounting the left massaging member 116L and a portion coupled to the drive element 114 of the drive motor 131. The second shaft portion 110R comprises a portion for mounting the right massaging wheel 116R. The rotary shaft 110 is divided into the first and second shaft portions 110L and 110R at a dividing end 110*a* located between the drive element 114 and the right massaging member 116R. The dividing end portions 110*b* and 110*c* of the first and second shaft portions 110L and 110R are preferably interconnected through a half-turn clutch 121.

Figure 11:
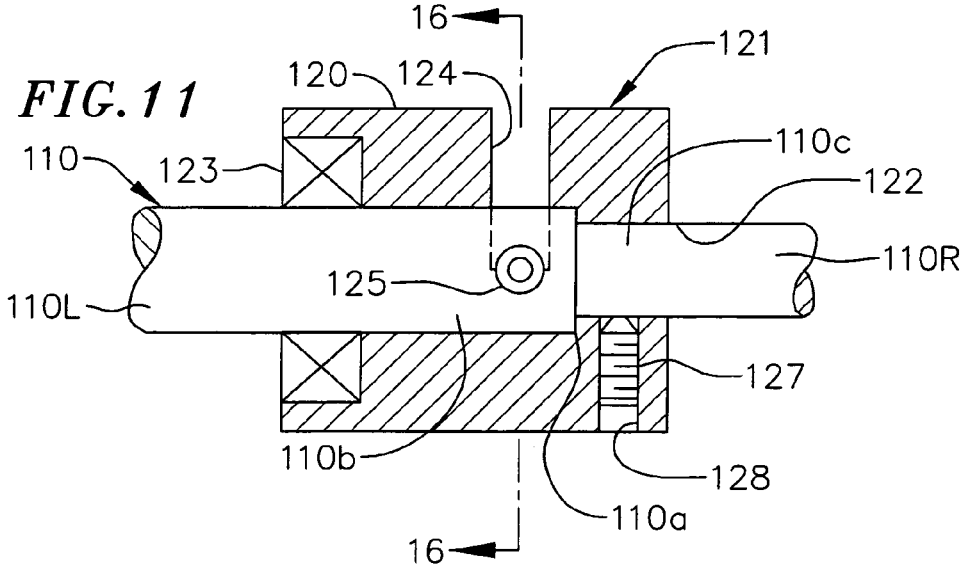
FIG. 11 is an enlarged partial cross sectional view of the clutch mechanism incorporated in the embodiment shown in FIG. 13.

As shown in FIG. 11, the half-turn clutch 121 includes a tubular member 120 unrotatably and coaxially secured to the dividing end portion 110*c* of the second shaft portion 110R, and a stopper pin 125 projecting radially outwardly of the dividing portion 110*b* of the first shaft portion 110L coaxially and rotatably inserted into the tubular member 120. The tubular member 120 is shaped cylindrical having a bore 122 axially extending through a central portion thereof, and a bearing 123 located on a peripheral edge portion of the opening adjacent the drive element 114 for receiving the dividing end portion 110*b* of the first shaft portion 110L for rotation. Further, the tubular member 120 is formed in an axially intermediate portion thereof with a semicircular transverse slot 124 which has a length circumferentially of the tubular member 120 corresponding to a half turn and which has a depth from the outer peripheral surface of the tubular member 120 to the bore 122. The stopper pin 125 is secured to the dividing end portion 110*b* of the first shaft portion 110L by, for example, thread engagement of a setscrew so as to project radially outwardly, and the tip portion of the pin 125 movably stays within the transverse slot 124.

Figure 12:
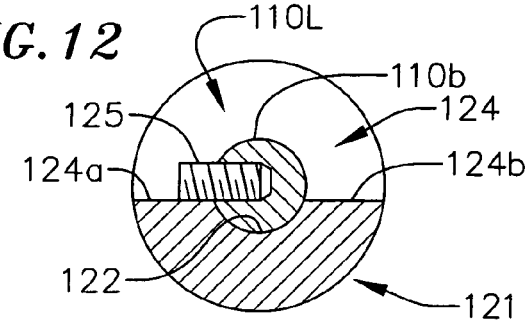
FIG. 12 is a cross sectional view of the section of the clutch shown in FIG. 17 taken along line 16—16.

The tubular member 120 defines in a right-hand side end portion thereof a tapped hole 128 for thread engagement with a setscrew 127 preventing the dividing end portion 110*c* of the second shaft portion 110R from rotating relative to the tubular member 120. The first shaft portion 110L of the rotary shaft 110 supporting the left massaging member 116L is turnable relative to the tubular member 120 forming the half-turn clutch 121 within a range of a half turn, while the second shaft portion 110R of the rotary shaft 110 supporting the right massaging member 116R is secured to the tubular member 120 unrotatably relative thereto. Accordingly, as shown in FIG. 12, when the first shaft portion 110L of the rotary shaft 10 is rotated counterclockwise by the drive element 114 (when viewed from a direction depicted by arrow 127 shown in FIG. 13), the stopper pin 125 comes to abut one radial end face 124*a* of the semicircular transverse slot 124 and causes the second shaft portion 110R to rotate counterclockwise together with the first shaft portion 110L. When the first shaft portion 110L is rotated clockwise (when viewed as indicated by arrow 127) from the condition in which the stopper pin 25 abuts the radial end face 124*a,* the stopper pin 125 moves within the transverse slot 124 to abut the other radial end face 124*b* of the slot 124 and afterward causing the second shaft portion 110R to rotate clockwise together with the first shaft portion 110L.

Figure 13A:
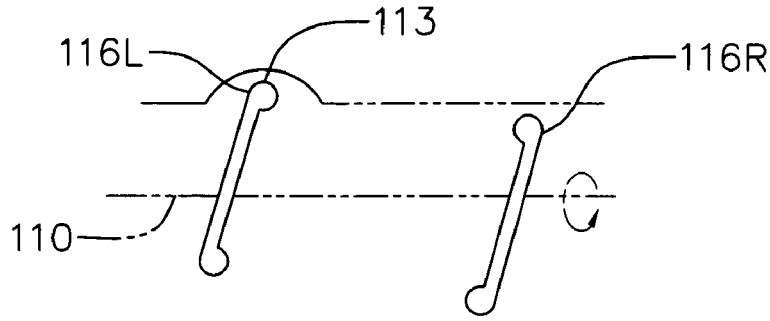
FIGS. 13A and 13B illustrate the massaging members in parallel, non-kneading motion.
Figure 13B:
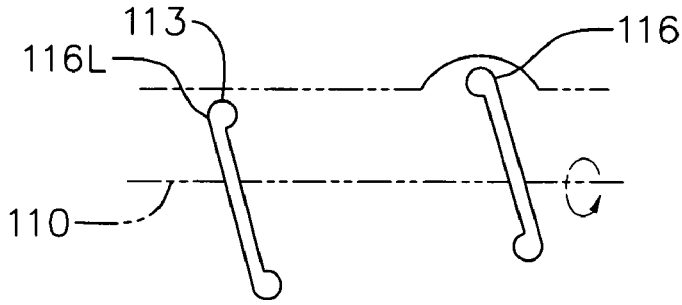
Figure 14A:
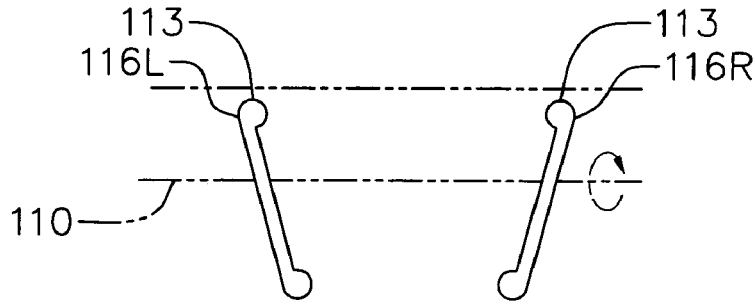
FIGS. 14A and 14B depict the massaging members of the present invention in nonparallel, kneading motion.
Figure 14B:
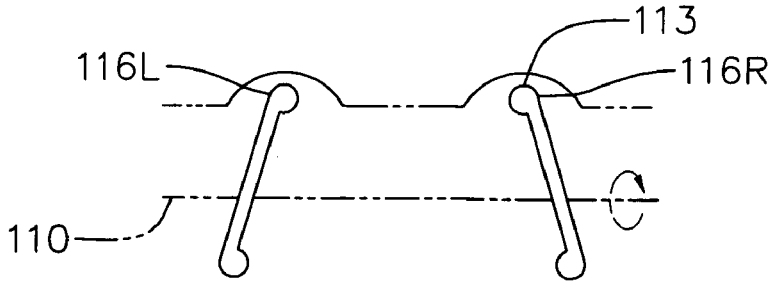

As the stopper pin 125 moves from the radial end face 124*a* to the opposite radial end face 124*b,* the motion of right massaging member 116R mounted on the second shaft portion 110R on the driven side changes relative to the left massaging member 116L. As a result, the massaging members 116R,116L can assume a non-kneading motion where the two massaging members 116L and 116R move in the same direction parallel with each other as indicated in solid line in FIG. 10, or alternatively a kneading motion where the two members 116L and 116R move in opposite directions as indicated in phantom line in FIG. 10. As shown in FIGS. 13 and 14, respectively, the half-turn clutch 121 forms switching means 126 for selectively switching the motion of the massaging members 116R,116L into one of the kneading motion, in which the pair of opposite massaging wheels 116L and 116R move opposite one another, and the non-kneading motion, in which they move in the same direction. In other words, by changing the direction of rotation of the rotary shaft 110, the relative motion of the members 116R, 116L is changed thereby changing the type of massage provided by the massaging members 116R,116L. In alternative embodiments, instead of the half-turn clutch 121, other mechanical electromagnetic or electromechanical switching means or clutches may be incorporated.

In preferred embodiments, the massaging members 116R, 116L are mounted eccentrically, or off-center relative to the rotary shaft 110 such that the lobes 113 of the massaging members 116R,116L move in a reciprocating fashion relative to the rotary shaft 110. Accordingly, when the rotary shaft 110 is rotatably driven from a start position, the lobe 113 of the massaging member 116 exerts pressure on the affected part of the user, which will gradually increase as the rotary shaft 110 rotates through a predetermined angle, 270° example, and then progressively decreases to zero during the remaining 90° of each turn to simulate the massaging actions of the hands of a masseur.

As shown in FIG. 10, the drive unit 114 is driven by a motor 131 (FIG. 6) that includes a gear reduction device 132 for transmitting the driving power of the motor 131 to the first shaft portion 110L of the rotary shaft 110 at a reduced speed. In a preferred embodiment, the gear reduction device 132 is integral with the motor 131. In alternative embodiments, the gear reduction device 132 may be a separate unit from the motor 131.

The gear reduction device 132 includes a gear case 129, a worm wheel 134 and a worm 135. The gear case 129 receives there through the rotary shaft 110 via bearings 130 for rotating the rotary shaft 110. Enclosed within the gear case 129 is the worm wheel 134, which is secured to a portion of the rotary shaft 110. The worm 135 is secured to output shaft 133 of the motor 131 and engaging the worm wheel 134. In this embodiment, the motor 131 can revolve forwards or backwards by way of an electric control circuit not shown. Hence, the forward rotation of the rotary shaft 110 can be switched to the backward rotation, and vice versa. The electric control circuit of the unit 114 is capable of varying the rotary speed of the rotary shaft 110 to at least two levels when the massaging members 116R,116L are in the non-kneading motion. In one embodiment, the speed varying operation may be effected stepwise. In an alternate embodiment, the speed varying function may be mechanical.

In the counterclockwise non-kneading motion, as illustrated in FIG. 13, the massaging members 116 translate from side-to-side parallel to each other. As the lobes 113 of the members 116R, 116L reciprocate relatively slowly in an alternate fashion, a finger pressure like massage is provided such as to press an affected part of the user heavily from the right and left. To achieve such a finger pressure-like massage, the rotary speed of the rotary shaft 110 is set to about 50 rpm. On the other hand, rotating the rotary shaft 110 at a relatively high speed with the massaging members 116R, 116L in the non-kneading motion causes the lobes 113 of the members 116L,116R to reciprocate alternately at a higher speed, thereby giving impacts to the affected part of the user, resulting in a tapping massage. To achieve such a tapping massage, the rotary speed of the rotary shaft 110 is set to 150 rpm or higher. Further, the rotary speed of 200 rpm provides the user with a particularly advantageous tapping massage.

In the clockwise kneading motion, as illustrated in FIG. 14, the massaging members 116R,116L translate from side-to-side, with the lobes 113 of the massaging members 116R, 116L gradually coming closer to each other while reciprocating, and subsequently retracting while going away from each other. In this motion, a kneading massage is provided. The rotary speed of the rotary shaft 110 is preferably set within a range from about 50 to about 60 rpm in the kneading massage.

Referring to FIG. 10, since the first and second shaft portions 110L and 110R are interconnected through the half-turn clutch 121, the second shaft portion 110R can rotate relative to the first shaft portion 110L undesirably due to the pressure imposed on the right massaging member 116R from the affected part of the user. As a result, the position of the massaging member 116R may shift to a position creating a motion (i.e., a kneading or non-kneading motion) that is different from the user selected motion. To prevent such inconveniences, the massaging unit 6 incorporates a first brake system 139 for providing a frictional resistance against rotation of the second shaft portion 110R on the driven side, which is not driven by the drive unit 114. Additionally, a second brake system 140 is used for providing frictional resistance against rotation of the pair of massaging members 116R,116L relative to the rotary shaft 110.

The first brake system 139 comprises a friction wheel 137 attached to the projecting end of the second shaft portion 110R, and a pressing spring 138 secured to the carriage 56 so that an end portion thereof presses upon the outer periphery of the friction wheel 137. Braking is accomplished by the frictional forces between the frictional wheel 137 and the pressing spring 138. The frictional forces act to retard the rotational momentum of the rotary shaft 110 and bring the shaft to rest.

The second brake system 140 employed in this embodiment comprises a ring spring 155 disposed on opposite sides of each massaging members 116R, 116L. The ring spring 155 is inserted into a clearance between each sandwiching plate 115*a*, 115*b* and each massaging members 116R,116L to provide a friction resistance against the rotation of the members 116R, 116L about the rotary shaft 110. As such, secondary braking is accomplished by pressing the respective slanted faces of the sandwiching plates 115*a* and 115*b* upon each massaging members 116R, 116L with an appropriate pressure.

The massaging unit 6 according to this embodiment is capable of selectively performing the kneading massage and other massaging operations by simply switching the rotational direction of the rotary shaft 110. Further, by simply varying the rotary speed of the rotary shaft 110 when the massaging members 116R, 116L are in the non-kneading motion, the massage device can selectively perform the finger pressure-like massage and the tapping massage. Thus, the massaging members 116L,116R, of a single kind, may perform three different kinds of massaging operations.

For the embodiment shown in FIG. 5, the user, through the use of a controller, can translate the carriage 56 to an appropriate location within a chair back for massaging a specific location of the user's back. This may be accomplished by engaging the drive unit that rotates the guide rod 90 relative to the cylindrical member 92. Accordingly, the cylindrical member 92 threads along the guide rod 90. The user selects the type of massage desired when the carriage reaches the appropriate location. Depending on the selection, the controller causes the massaging members 116R, 116L to rotate in the appropriate direction (i.e., clockwise or counterclockwise) and at the appropriate speed.

The relative mounting of the massaging members 116R, 116L to the shaft 110 is given herein by way of example. It may be, for example, that the members 116R, 116L are mounted such that counterclockwise rotation of the members 116R, 116L (when viewed from the direction depicted by arrow 127 as shown in FIG. 10), would cause the two massaging members 116R, 116L to move in a parallel fashion, or the members 116R, 116L may be mounted such that rotation in a counterclockwise direction (when viewed from the direction depicted by arrow 127 in FIG. 13) would cause the members 116R, 116L to orient themselves in a non-parallel relationship such that they are slanted towards each other. Moreover, the type of massages to be given by the massaging members 116R,166L can be further controlled by controlling the degree of the relative eccentricity of the two massaging members 116R,116L relative to the shaft 110.

Figure 15:
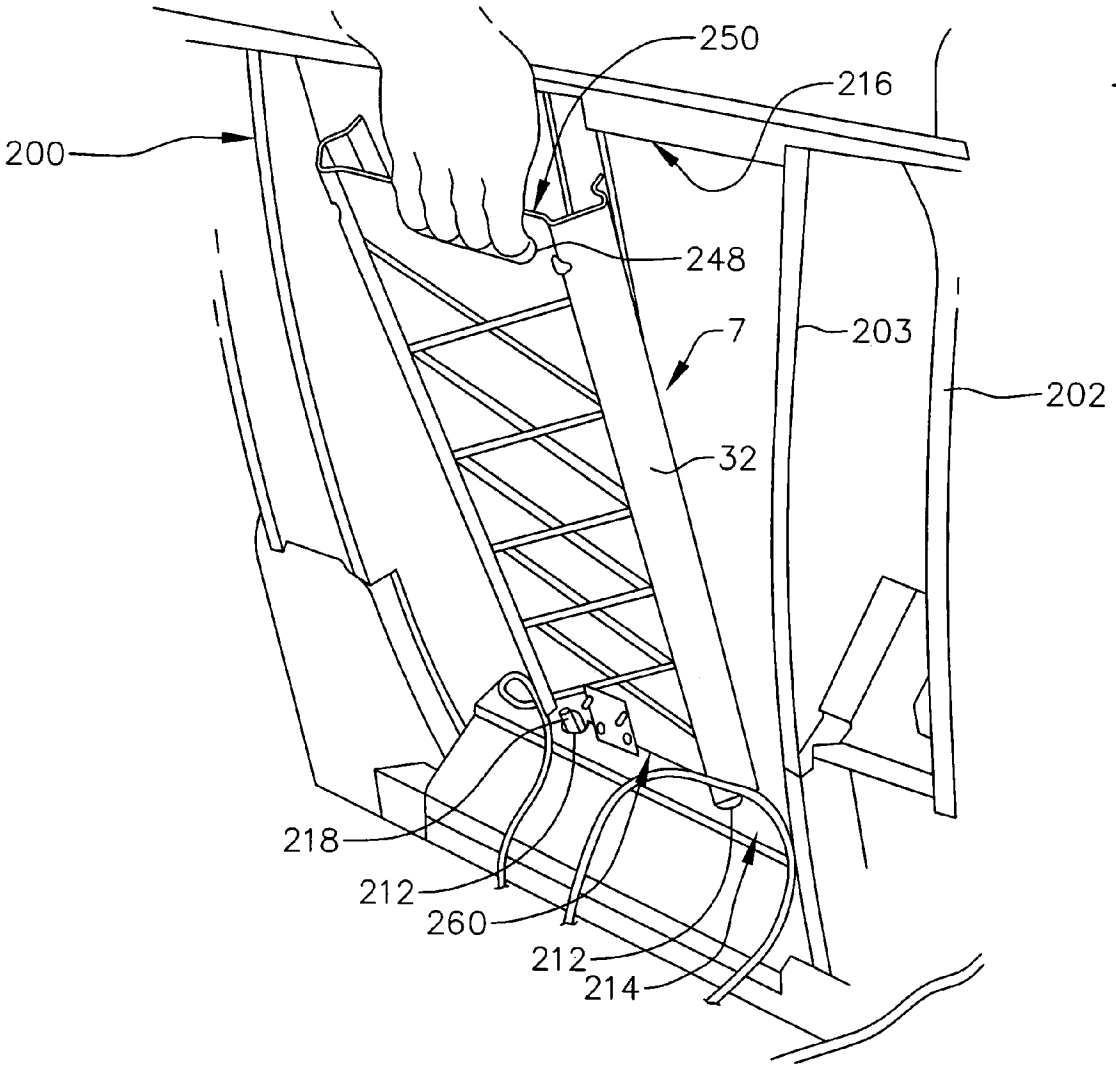
FIG. 15 is a perspective view of a conventional recliner incorporating the massaging device of the present invention.

Referring to FIG. 15, the massaging device 7 of the present invention can be incorporated in a conventional recliner 200. It is preferred that the conventional recliner has a frame 203 on its back 202 to accept the massaging device 7. In a preferred embodiment the frame 203 comprises opposing faces 214 and 216, each face comprising a pair of apertures 212. A pair of fasteners 218 are displaced along the proximal 250 and distal 260 ends of the support structure 32 for engaging the apertures 212 and retaining the massaging device 12 within the back 202 of the recliner 200.

Figure 16:
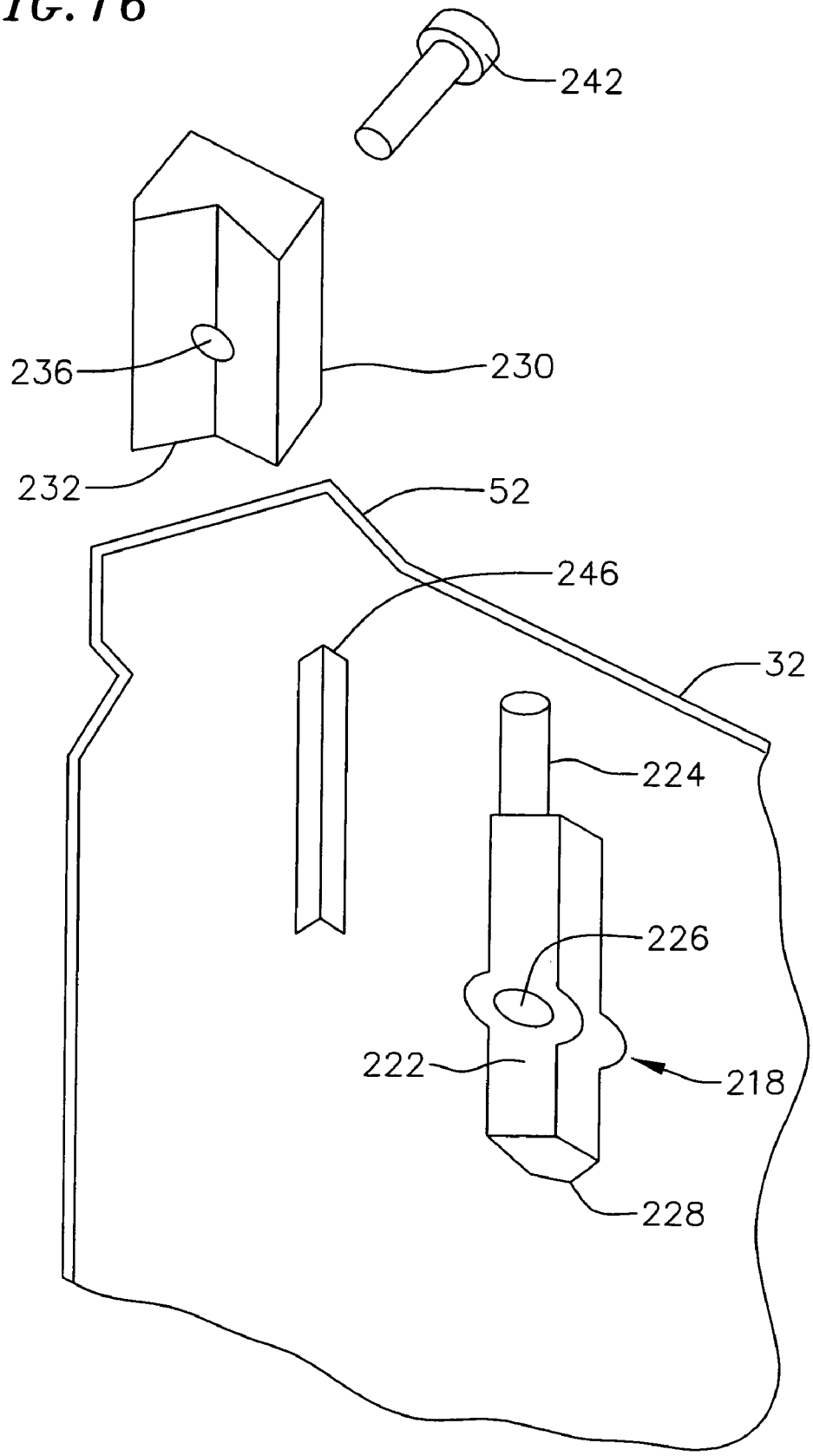
FIG. 16 is an exploded perspective view of the adjustable fastener used to secure the massaging device to the recliner shown in FIG. 15.

As shown in FIG. 16, each fastener 218 comprises a sliding body 222 and nut plate 230. The body 222 comprises a V-shaped profile 228, for mating the first raceway 52, and a threaded aperture 226, located in a central portion of the body 222. The sliding body 222 preferably comprises aluminum, but may be made of any suitable material. A tubular shank 224 extends from an end of the body 222 for engaging the aperture 212. The nut plate 230 comprises a V-shaped groove 232, for mating the underside of the first raceway 52, and a threaded bore 236, located in a central portion of the plate 230. The nut plate 230 preferably comprises aluminum, but may be made of any suitable material. The fastener 218 is adjustable, as the sliding body 222, and nut plate 230 are coupled by threaded member 242 to translate in unison along the first raceway 52. The threaded member 242 engages aperture 226 and bore 236 within a notch 246 in the first raceway 52, defining the fastener's 218 translation. The fastener 218 is fixed in a particular position by engaging the threaded member 242 within the aperture 226 and bore 236, causing the profile 228 and groove 232 to contact the first raceway 52.

Figure 17:
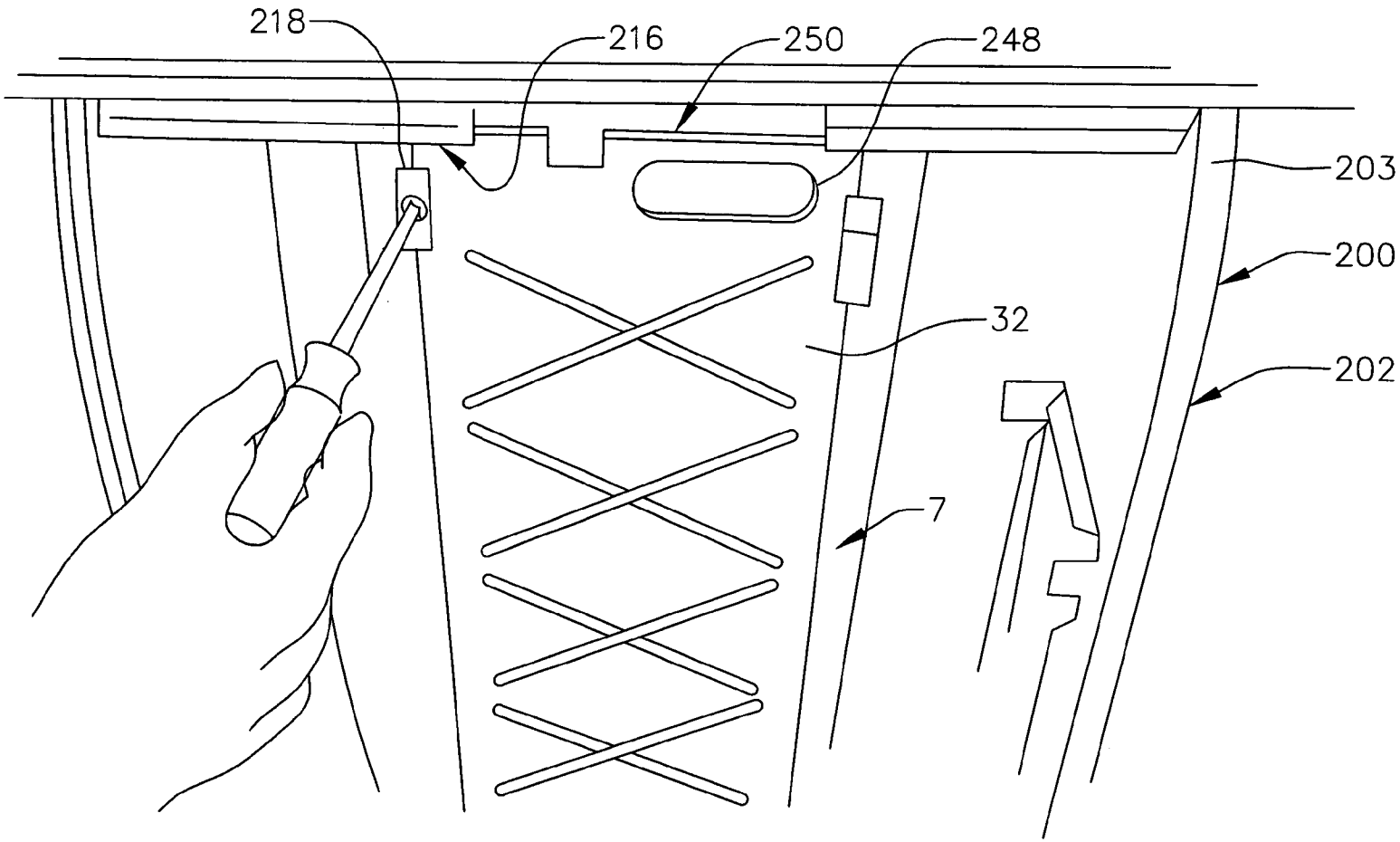
FIG. 17 is a perspective view of the recliner incorporating the massaging device shown in FIG. 15.

As shown in FIG. 17, the massaging device 7 is preferably removed from the recliner 200 by loosening the fasteners 218 on the proximal end 250 of the support structure 32. The fasteners 218 will then disengage the pair of apertures 226 on the face 216 of the frame 203. A slit defining a handle 248 is located at the proximal end 250 of the bracket, allowing the user to handle the device 7, tilt it, and remove the unit from the back 202 of the recliner 200. The massaging device 7 can then be transported for service or maintenance as a modular unit. Similarly, after maintenance, the massaging device 7 may be installed into the back 202 of the recliner 200, by engaging the pair of fasteners 218 on the distal end 260 of the support structure 32 into corresponding apertures on the face 214 of the frame 202. Using the handle 248, the pair of fasteners 218 on the proximal end 250 of the support structure 32 are aligned with the pair of apertures 226 on the face 216 of the frame 203. The fasteners 218 are then adjusted to engage the apertures 226 and the threaded members 242 are tightened to hold the fasteners 218 in place.

Figure 18:
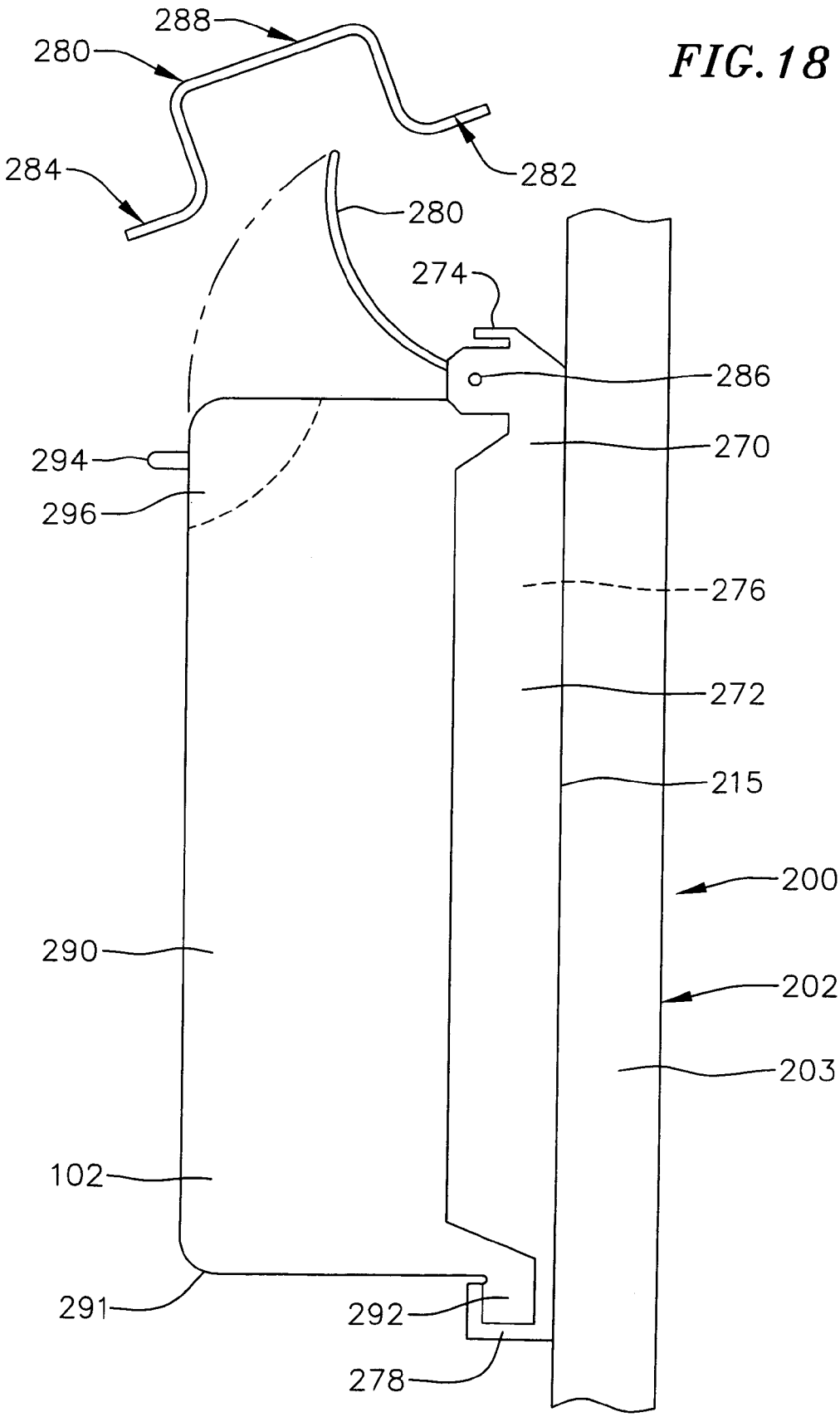
FIG. 18 is a partial side view of the back of the recliner shown in FIG. 15.

Referring to FIG. 18, the controller 102 is retained in the back 203 of the recliner 200, along a face 215 of the frame 203, by a retainer bracket 270. The retainer bracket 270 is preferably sheet metal, forming substantially rectangular sidewalls 272, 274 and 275 and fold 278. Sidewalls 272 and 276, each comprise holes 286 aligned with each along a portion of the sidewalls 272 and 276. Ends 282 and 284 of a substantially U-shaped retainer rod 280 are rotatably coupled to the holes 286, enabling a central portion 288 of the retainer rod 280 to rotate about the center of the holes 286.

The controller 102 comprises a housing 290 having a flange 292, extending from the base of a front portion of the housing 290, and a pair of clasp 294, coupled along a rear portion of the housing 290.

Figure 19:
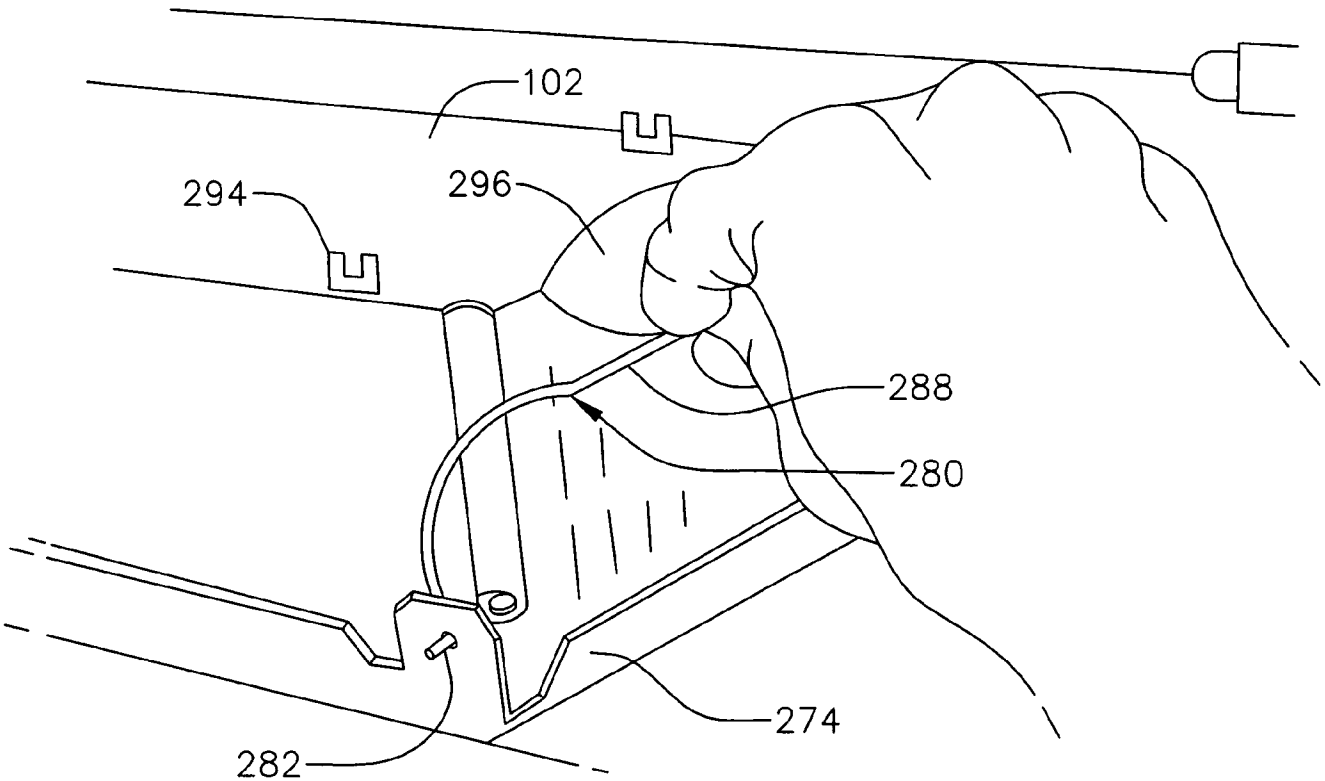
FIG. 19 is a partial perspective view of the back of the recliner shown in FIG. 15.

Referring to FIG. 19, when installed, the flange 292 of the controller 102 engages the fold 278 (not shown) and the retainer rod 280 is rotated, such that the central portion 288 of the retainer rod 280 is fastened within the clasp 294. The controller 102, further, comprises a cutaway 296, allowing the user access to handle the retainer rod 280.

Figure 20:
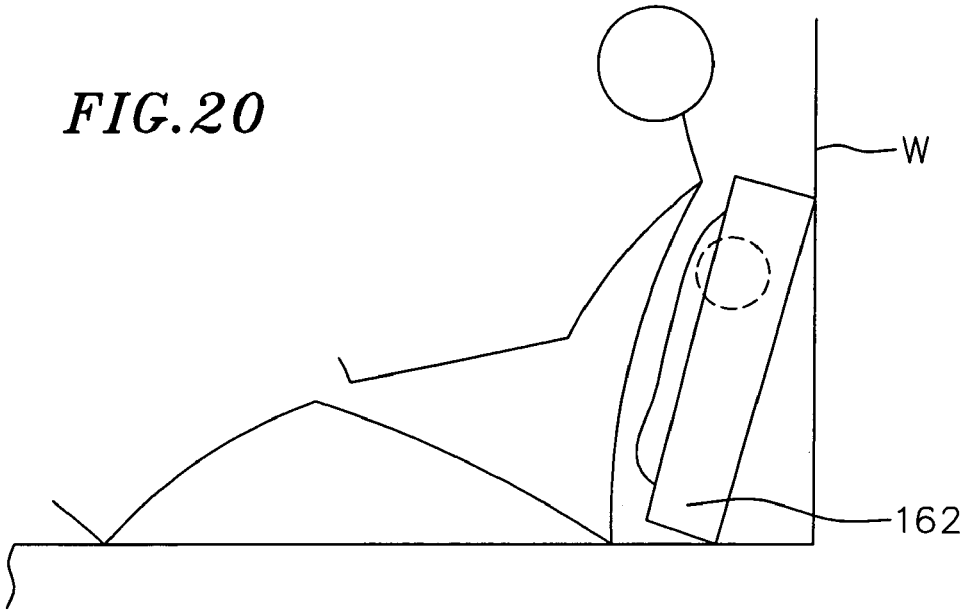
FIG. 20 is a schematic view of a massaging device incorporated in a stand alone unit leaning against a wall.
Figure 21:
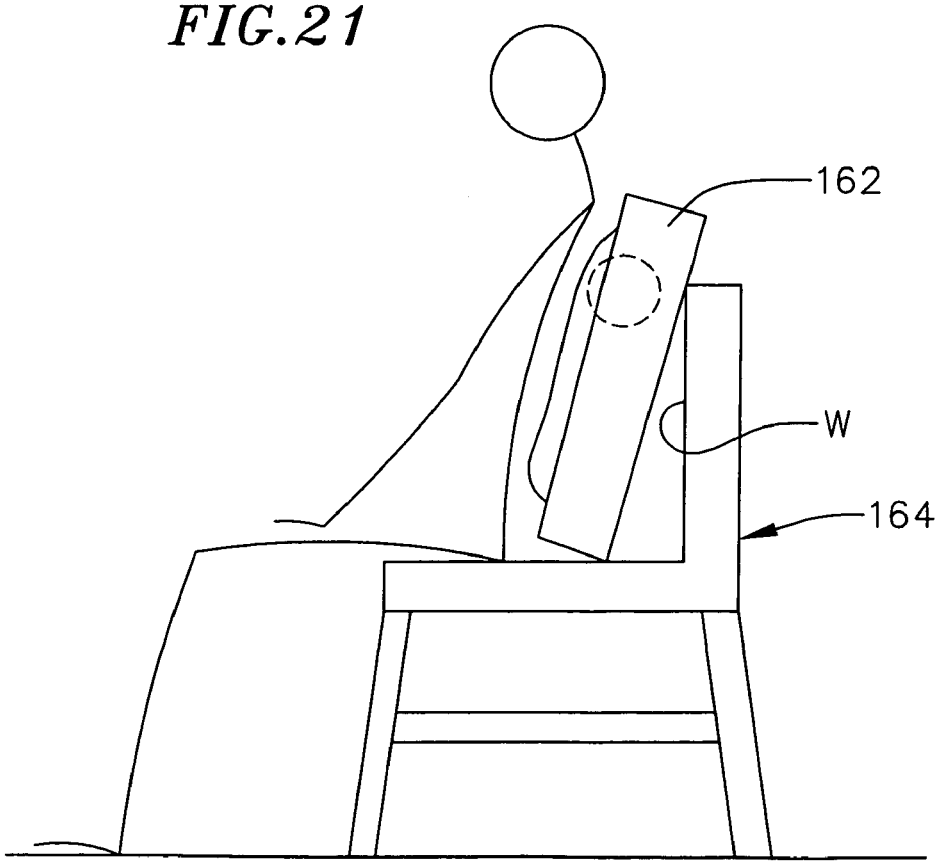
FIG. 21 is a schematic view of a massaging device incorporated in a stand alone unit and leaning against the back of a chair.

The massaging device of the present invention can also be incorporated in a stand-alone or one-piece back rest as shown in FIGS. 20 and 21. A stand-alone or one-piece casing 162 should have longitudinal length substantially corresponding to that of the back of a human. Such a one-piece device may be leaned against a wall W or against the back of a chair 164 for providing a massage. The overall configuration of the casing 162 used in this embodiment is a longitudinally elongated flat box. This configuration allows for easy storage in narrow spaces such as in a corner of a room or between furniture articles.

The massaging members 116L,116R may each be differently varied in configuration so long as the overall configuration thereof is substantially discoid, for example, in the form of an elliptic disc or a polygonal disc. In alternative embodiments, the lobes 113 of the massaging members 116R, 116L may be configured in the form of a combination finger and fist. In this embodiment, the boss portion 115 is rotatably mounted to the rotary shaft 110, such that the finger configuration may be used, while the fist configuration is positioned out of use. Alternatively, the boss portion 115 may be fixed about the rotary shaft 110, such that the fist configuration may be used, while the finger configuration is positioned out of use. In an additional embodiment, the lobes 113 of the massaging members 116R,116L may be detachable elements in the form of a fist, finger or the like. The members would be fastened to and detachable from the central portion of the massaging members 116R,116L.

Figure 22:
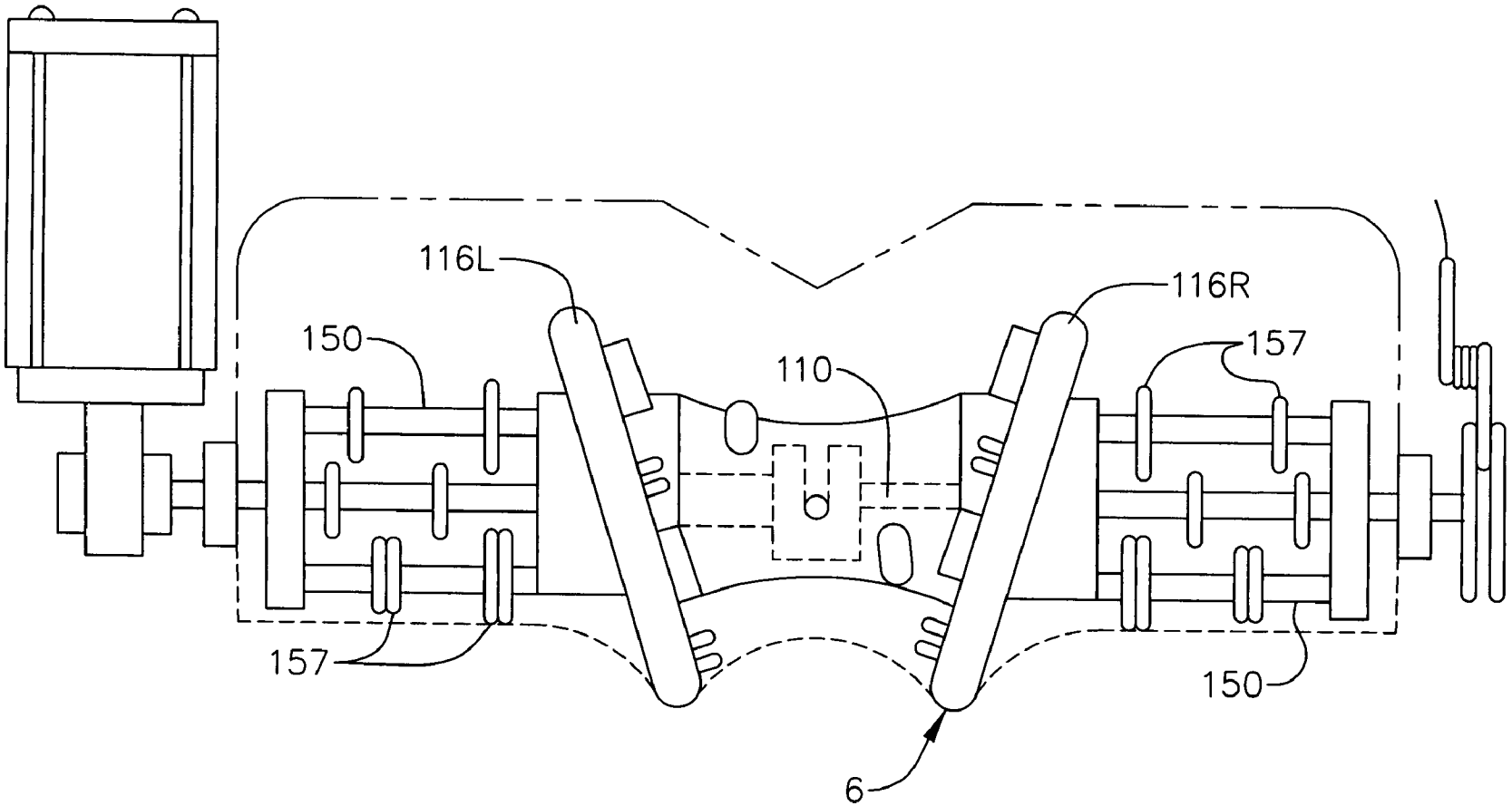
FIG. 22 is a partial end view of a massaging device incorporating additional multiple smaller massaging wheels.

Moreover, instead of two massaging members, one or more massaging members may be incorporated in the massaging device. For example, many smaller massaging wheels 157 may be coupled to shafts 150. These shafts 150 are coupled to the massaging unit 6 in parallel to the rotary shaft 110, as shown in FIG. 22.

The massaging device of the present invention, incorporating non-rotary massaging members partially discoidal in shape, provides a profile thinner than massaging devices of the prior art. Having non-rotary massaging members are advantageous because only the portion of the member that contacts the affected part of the user require a large radial peripheral. Further, the substantially radial cross-section of the massaging members of the present invention is such that parts of the user (e.g. a users finger or flesh) will not be pinched between the support frame of the massaging unit and the massaging members. Moreover, the use of massaging members comprising polished plastic minimizes frictional contact between the massaging members and the affected chair fabric, and thus reduces wear on the chair fabric.

If desired, the massaging unit 6 of the present invention may be translated along a track forming two C-shaped rails. The biasing wheel 72 of the present invention may also be coupled to a massaging unit translated along a track forming two C-shaped rails. Further, the diamond shaped guide wheels 60 and biasing wheel 72 of the present invention may be coupled to a messaging unit comprising a pair of massage wheels. A description of such a track and massaging unit are described in PCT International Application No. PCT/JP99/01340 (filed Mar. 17, 1999), the disclosure of which is incorporated herein by reference.

According to another aspect of the present invention, the massaging device may include the massaging unit being positionally adjustable within the apparatus in which it is incorporated. More specifically, the support structure along which the driving mechanism and massaging members move, may be adjusted towards and away from the massaging surface, including being retracted from the massaging surface if the user does not desire massaging action, and being in contact with the interior of the massaging surface, the exterior of which is adapted for a user's body part to rest against. In one exemplary embodiment, the generally planar support structure may be positioned in a plurality of positions, each being substantially parallel to the massaging surface. In another exemplary embodiment, the support structure may be pivotally moveable and obliquely positionable with respect to the massaging surface.

Various means may be used to adjust the support structure and massaging unit. Examples of means used to adjust the massaging unit by causing the support structure to pivot, include a series of pivotally-coupled links coupled to a shaft, and a cam coupled to a shaft. A handle or motor or both may be used to rotate the shaft and thereby adjust the support structure by causing it to pivot. In the preferred embodiment, the support structure will be generally planar and parallel to the massaging surface and surrounded peripherally by a bracket. In another exemplary embodiment, the bracket may extend only along opposed sides of the support structure. The bracket is fixed with respect to the massaging apparatus. The support structure along which the driving mechanism and massaging members move, may be hinged with respect to the peripheral bracket so that the support structure is pivotally moveable and obliquely positionable with respect to the bracket. In an exemplary embodiment, the massaging surface is generally vertical and the massaging members travel along the support structure which is generally vertical and parallel to the massaging surface, which may be the back portion of a chair, for example. According to the exemplary embodiment in which the massaging surface is generally vertical, the support structure may be hinged on top and free to swing on the bottom in a preferred arrangement. According to another exemplary pivoting arrangement, the support structure may be hinged on the bottom and free to swing on top. Examples of various mechanisms which may be used alone or in combination, to cause the support structure to move towards and away from the massaging surface include a handle, a wire and drive wheel mechanism, a belt, various other motors, a gear or combination of gears, various other linkages, a bellows in conjunction with an air pump, pneumatics, and electrical means using a screw drive mechanism. The support structure may be positionable in a number of fixed positions when deployed for massaging such that the massaging members contact the interior portion of the massaging surface and exert various degrees of massaging pressure. Various means may be used to locate and select the various positions, and also to lock the support structure into the selected positions.

For the exemplary embodiment in which the massaging mechanism is incorporated within the back of a chair, the massaging unit may be disposed in various massaging positions such that the massaging members travel along and contact an interior surface, the exterior surface of which a user's back may be disposed against when a massage is desired. In the chair embodiment, for example, the massaging unit may also achieve at least one position being retracted from the interior surface such that the massaging members are not in contact with the interior surface and the chair may be utilized as a standard office chair, for example.

Figures 23A, 23B, 23C:
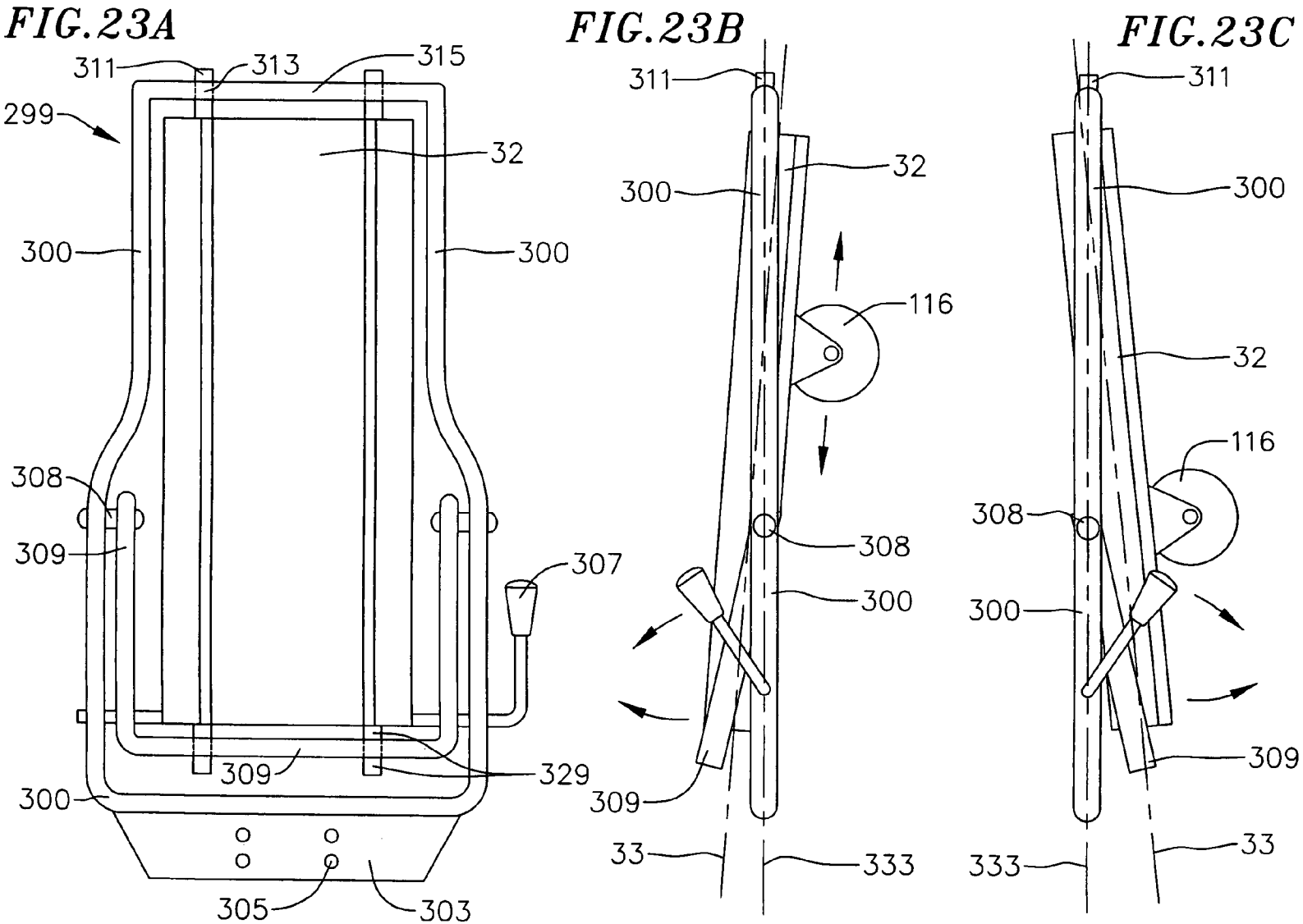
FIG. 23A is a front view of an exemplary embodiment of an adjustable massaging device of the present invention and FIGS. 23B and 23C are side views of the adjustable massaging device.

FIG. 23A shows adjustable massaging device 299 including support structure 32. The massaging unit (6 as shown in FIGS. 1 and 5) is disposed upon support structure 32. Support structure 32 is generally planar in the exemplary embodiment and will be generally parallel to the plane of movement of the driving mechanism (as shown in FIG. 2) which drives the carriage and causes the carriage assembly to translate axially along the guide rails of support structure 32. In the exemplary embodiment, support structure 32 is pivotally attached to peripheral bracket 300. Peripheral bracket 300 may alternatively be referred to as a support frame. Bracket 300 may be attached to, or it may be an integral part of, the apparatus in which adjustable massaging device 299 is installed. For example, flange 303 may be formed integrally with bracket 300 and holes 305 may be used to secure bracket 300 into position within the apparatus. According to another exemplary embodiment, bracket 300 may be part of the frame of a chair, such as frame 203 shown in FIG. 15. Bracket 300 may be formed of metal, wood, or other suitably strong materials. In an exemplary embodiment, bracket 300 may be formed of metal tubing. Various means besides exemplary holes 305 and flange 303 may be used to secure bracket 300 into position within the apparatus in the exemplary embodiment in which adjustable massaging device 299 is not formed integrally as part of the apparatus. Furthermore, the shape of bracket 300 and relative configuration of bracket 300 and support structure 32, are intended to be exemplary only.

Figure 24A:
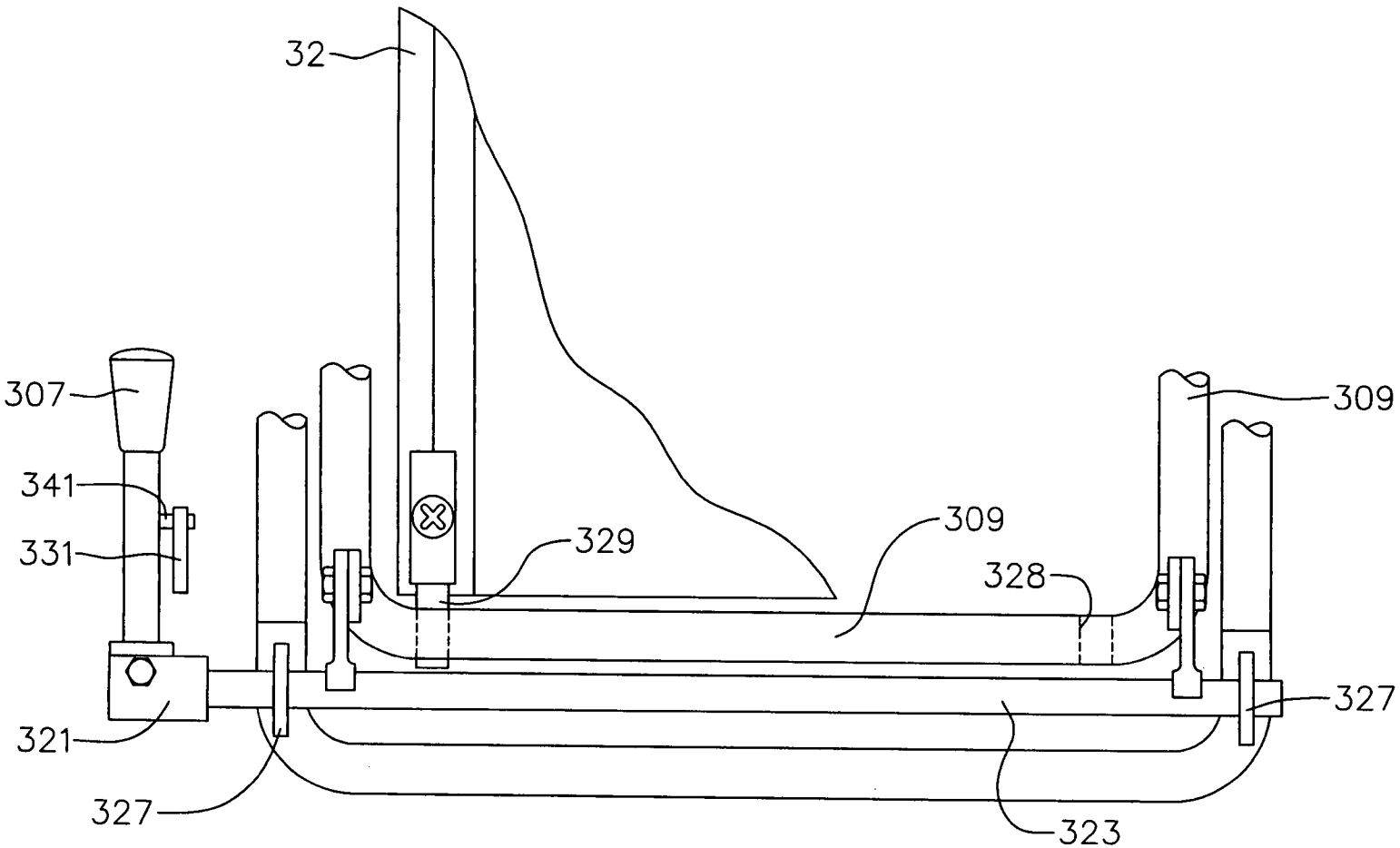
FIG. 24A is a front, cut-away view illustrating details of an exemplary adjustment mechanism of the present invention.

Adjustable massaging device 299 includes swing bracket 309 attached to bracket 300 by pivot 308 and movable by adjust handle 307. Swing bracket 309 is made of a rigid and strong material, such as wood or various metals. The position of pivot 308 along the side of bracket 300 may vary but may be approximately centrally disposed in the preferred embodiment. The operation and configuration of adjust handle 307 will be shown in additional detail in FIGS. 24A–24C. Pins 329 secure support structure 32 to lower portion of swing bracket 309. Pins 311 slidably join support structure 32 to top portion 315 of bracket 300 and allow for movement of support structure 32 with respect to bracket 300 when swing bracket 309 pivots about pivot 308 responsive to the movement of adjust handle 307. Pins 311 extend through holes 313 which extend through top portion 315 and may preferably include a grommet of a suitable material such as rubber therein, to allow for pins 311 to slide slightly within holes 313 when support structure 32 pivots about pivot 308 responsive to movement of adjust handle 307. Pins 311 may move on the order of 2–3 millimeters, up and down, within holes 313 as the massaging device moves towards and away from the massaging surface. Grommets formed of other materials and other bushings may be used to allow for smooth movement of pins 311 within holes 313 and also to provide for vibration damping. In the exemplary embodiment shown in FIG. 23A, support structure 32 is hinged to the top of bracket 300 and is free to swing at the bottom of bracket. This arrangement may be reversed according to other exemplary embodiments.

FIGS. 23B and 23C are side views of the exemplary embodiment shown in FIG. 23A and also include massaging member 116 for clarity. Massaging member 116 may represent either or both of massaging members 116L or 116R, described previously. In the preferred embodiment, support structure 32 includes each of massaging members 116L and 116R. FIGS. 23B and 23C show plane 33 through which the driving mechanism (see FIG. 5) and massaging member(s) 116 move along support structure 32. Plane 33 is obliquely positionable with respect to plane 333 of bracket 300 when support structure 32 moves with respect to bracket 300 as swing bracket 309 pivots about pivot 308 responsive to the movement of adjust handle 307. In an exemplary embodiment, FIG. 23C may represent massaging member 116 in its deployed massaging position and the exemplary embodiment shown in FIG. 23B may represent massaging member 116 in a position retracted from the massaging surface.

Swing bracket 309 and therefore plane 33 of support structure 32 pivot with respect to bracket 300 due to the movement of adjust handle 307 and the configuration of the coupling links. Now turning to FIG. 24A, adjust handle 307 is connected to rotatable shaft 323 by means of pivot elbow 321. The movement of adjust handle 307 causes rotatable shaft 323 to rotate. Shaft 323 extends through openings formed in flanges 327 which are fixedly secured to bracket 300 at opposed lateral locations on the same side of bracket 300. Shaft 323 is capable of rotation within the openings formed in flanges 327 and is fixedly attached to link 335 as will be shown in FIGS. 24B and 24C. Adjust handle 307 includes pin 341 which is received by apertures in position lock 331 to lock adjust handle 307 and support structure 32 into various positions. Pins 329 secure support structure 32 to the lower portion of swing bracket 309 through apertures 328. Apertures 328 extend into or through swing bracket 309 and may preferably contain a rubberized bushing to dampen vibration.

Figure 24C:
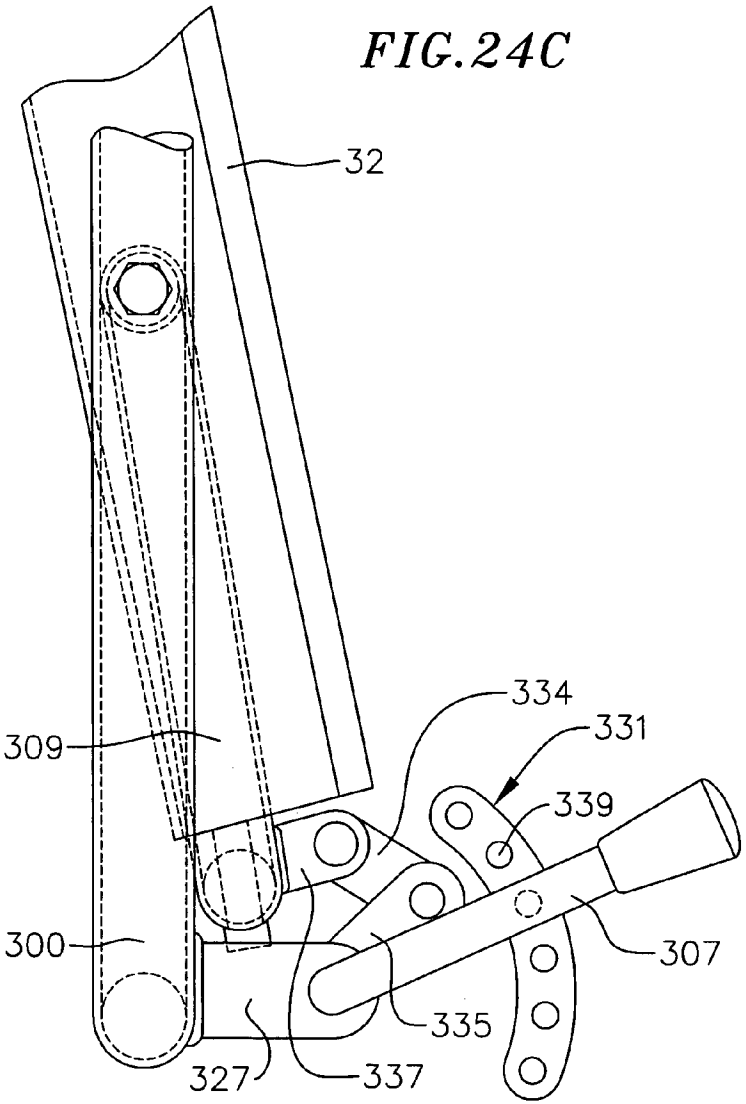
FIGS. 24B and 24C are side views illustrating details of the adjustment mechanism.
Figure 24B:
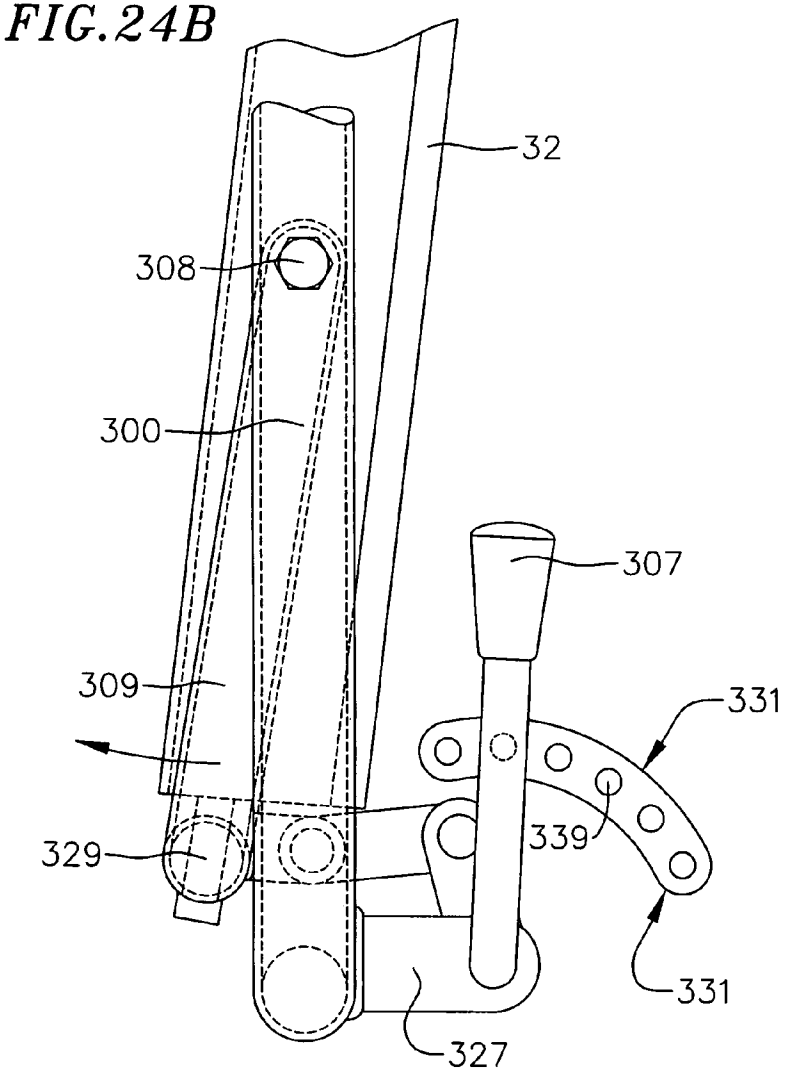

FIGS. 24B and 24C show that, when the movement of adjust handle 307 causes shaft 323 to rotate, links 334, 335 and 337 cause swing bracket 309 to pivot about pivot 308, and support structure 32 to move obliquely with respect to bracket 300, which is fixed in position within the apparatus in which it is incorporated and therefore with respect to the massaging surface. Links 334, 335 and 337 are pivotally attached to one another and link 337 is fixedly attached to swing bracket 309. Position lock 331 includes apertures 339 for receiving pin 341 which extends from adjust handle 307, and provides a number of locked positions. The locked positions will include at least one retracted position in which the massaging members (not shown) are retracted from the massaging surface such as when the massaging feature is not desired. Various other of the locked massaging positions allow for the massaging members (not shown) to be in contact with an interior surface, the exterior surface of which a user's body part may be disposed against when a massage is desired. As such, when bracket 300 is fixedly attached within an apparatus in which the adjustable massaging device 299 is installed, support structure 32 and therefore plane 33 of movement of the driving mechanism are displaced with respect to fixed parts of the apparatus, and may be locked into various massaging positions as well as at least one retracted position when the massaging feature is not desired. The various massaging positions correspond to various massaging pressures exerted upon the interior of the massaging surface by the massaging members.

According to still other exemplary embodiments, the pivoting motion of the swing bracket and support structure may be motorized. A conventional motor controlled by conventional means may be used to rotate shaft 323 and adjust the position of support structure 32. The motor may cause the support structure to move in a smooth or step-wise fashion. The motor may be electronically programmed using various conventional means. The massaging program may include the swing bracket and support structure being positioned at various massaging positions to provide various massage pressures during a massaging routine, then preferably retracting the support structure to a home, non-massaging position after the massaging routine is completed.

Figure 25:
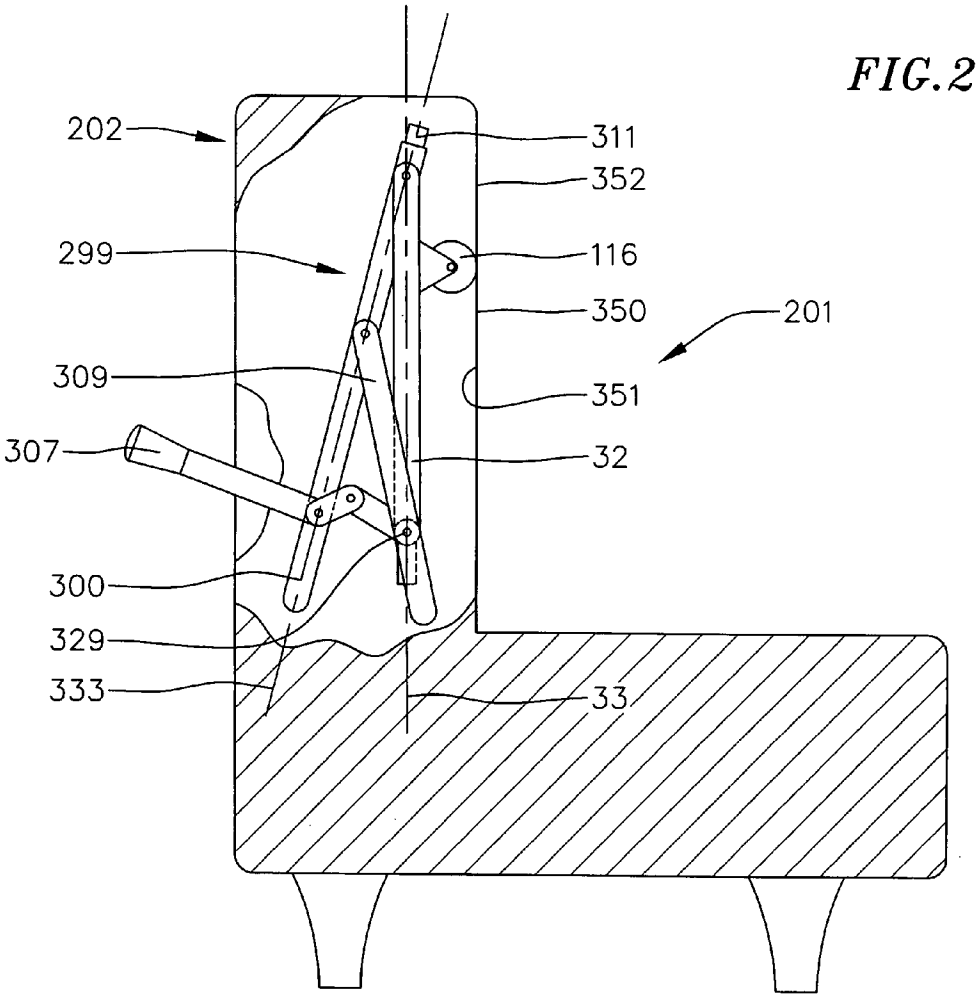
FIG. 25 is a partial cross-sectional view of an exemplary adjustable massaging device incorporated into an exemplary chair.

Now referring to FIG. 25, an exemplary adjustable massaging device 299 is shown installed in an exemplary apparatus—chair 201. Chair 201 may be an upright chair having a back section 202 capable of receiving adjustable massaging device 299. It should be understood that adjustable massaging device 299 may alternatively be incorporated within various other chairs or other units. In an exemplary embodiment, chair 201 may be a recliner, such as recliner 200 described in conjunction with FIGS. 15, 17 and 18. In the exemplary embodiment shown, adjust handle 307 is coupled to adjustable massaging device 299 and is positioned exterior to chair 201. According to another embodiment, adjust handle 307 may be positioned in different locations. According to still another embodiment, adjust handle 307 may not be used and a motor may be used to adjust the position of the support structure and the massaging unit. Bracket 300 is installed in a fixed position within back section 202. Various means may be used to secure bracket 300 into fixed position within chair 201 or bracket 300 may be manufactured as an integral part of chair 201. A receiving frame such as frame 203 shown in FIG. 15, for example, may be included within back section 202 for receiving bracket 300. It can be seen that bracket 300 is in a generally vertical position but in the exemplary embodiment shown in FIG. 25, it is angled slightly with respect to receiving panel 350 to accommodate support structure 32 being hinged to the top of bracket 300, such as the case of the exemplary embodiment shown in FIGS. 23B and 23C, in which the support structure is hinged to the top of bracket 300 and moves obliquely with respect to bracket 300. According to various other exemplary embodiments, in contrast, bracket 300 may be positioned differently, with respect to receiving panel 350.

Back section 202 includes receiving panel 350 which includes interior surface 351 and exterior massaging surface 352. A user's back (not shown) will preferably rest against exterior massaging surface 352 of receiving panel 350 when the chair is being occupied. Receiving panel 350 is formed of a soft and compliant material and may alternatively be referred to as massaging panel 350. In the configuration shown in FIG. 25, massaging member 116 is substantially in contact with interior surface 351 of receiving panel 350. In this manner, a massaging action will be achieved upon receiving panel 350 and the user's back may be desirably massaged when the user occupies chair 201. Massaging member 116 may also be in contact with interior surface 351 when locked into various other massaging positions in which massaging member 116 presses against interior surface 351 to various other degrees and therefore provides various massage pressures upon the user's body which contacts exterior massaging surface 352. In yet another position in which support structure 32 is moved obliquely with respect to bracket 300, support structure 32 and massaging member 116 will be retracted with respect to receiving panel 350. Support structure 32 and massaging member 116 are capable of being retracted and fixed into at least one position in which massaging member 116 does not contact interior surface 351. Configured as such, chair 201 may be used as a standard office chair without massaging member 116 or other components of the massaging unit contacting receiving panel 350. For example, support structure 32 may be obliquely retracted away from receiving panel 350 such that plane 33 of movement of the drive mechanism, is substantially parallel to plane 333 of bracket 300 or such that portions of support structure 32 are positioned rearward of bracket 300. When bracket 300 is positioned at an angle with respect to receiving panel 350, as illustrated, massaging member 116 will preferably rest in the lowest position, so as to be furthest retracted from receiving panel 350, when support structure 32 is in its home, retracted position and the massaging device is not in use. According to the exemplary embodiment in which a massaging program is used in conjunction with a motor to position swing bracket 309 and support structure 32, the lowermost position will be the home position to which massaging member 116 is returned after use. Various other configurations and methods, such as described above, may be used for mechanically moving the massage unit back and forth and into and out of contact with receiving panel 350.

Figure 26:
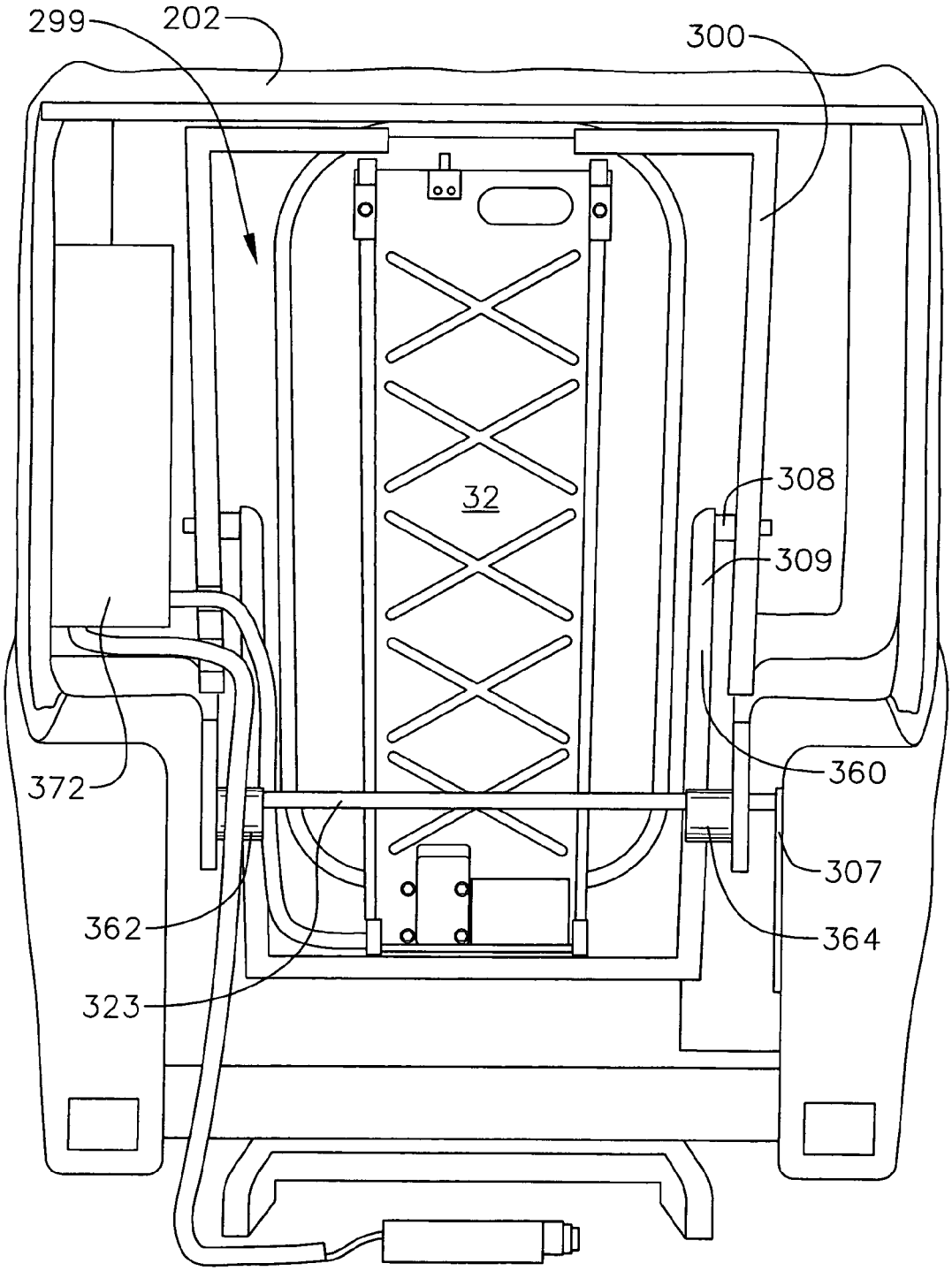
FIG. 26 is a rear view of another exemplary adjustable massaging device installed in the back of an exemplary chair.

FIG. 26 illustrates another exemplary embodiment of means for adjusting the massaging device. FIG. 26 shows the adjustable massaging device positioned within the back of a chair. Exemplary back section 202 of a chair (not shown) includes adjustable massaging device 299 installed therein. FIG. 26 is a back view of back section 202 and therefore, shows adjustable massaging device 299 from the rear, including bracket 300 and swing bracket 309 pivotally coupled to stationary bracket 300 through pivot 308. Bracket 300 may be formed of wood or metal and may preferably be an integral portion of the frame structure of chair back 202. Support structure 32 is coupled to swing bracket 309 at the bottom of swing bracket 309 and pivots as described in the previous embodiment when swing bracket 309 pivots with respect to bracket 300. In the exemplary embodiment, cams 362 and 364 are fixed about shaft 323 and contact rear surface 360 of swing bracket 309. Cam shaft 323 includes an orthogonal cross-section in this exemplary embodiment but other configurations may also be used. When cam shaft 323 is rotated, the irregularly shaped cams 362, 364 rotate and adjust the position of swing bracket 309 and therefore support structure 32 and the massaging device. The rotation of rod or cam shaft 323 may be caused by adjust handle 307 as described previously, or it may be caused by a motor such as may be contained in controller 372 which may impart rotational motion upon cam shaft 323 by gears or other means.

Figure 27:
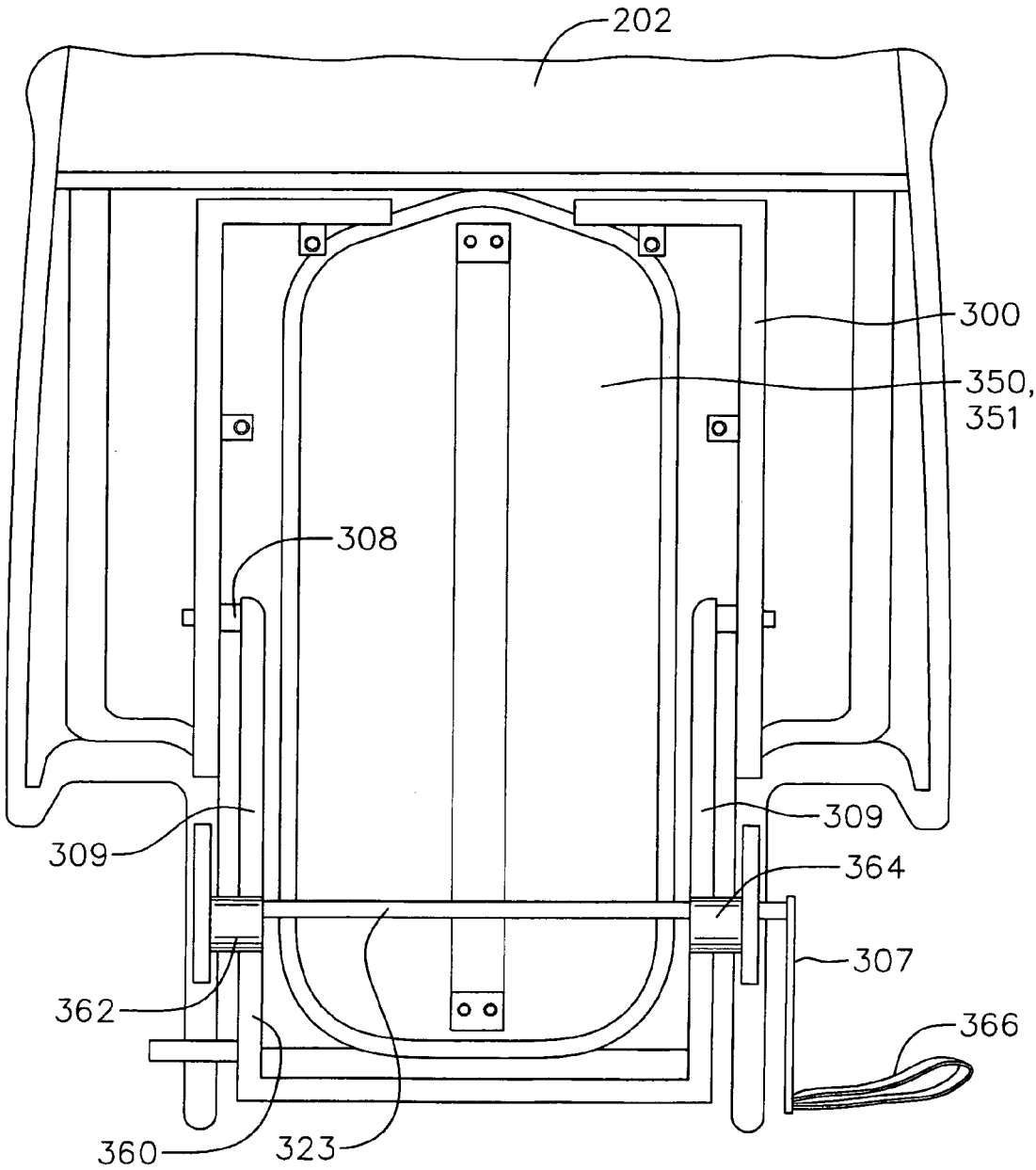
FIG. 27 is another rear view similar to FIG. 26 and illustrating the inside of the massaging surface.

FIG. 27 shows the apparatus shown in FIG. 26 but does not include controller 372 or support structure 32. Rather, FIG. 27 shows interior surface 351 of receiving panel 350, the exterior massaging surface of which the user's back will rest against. Exterior massaging surface 352 is shown in FIG. 25. When deployed in massaging position, the massaging members of the massaging unit (not shown) contact interior surface 351.

Figure 28B:
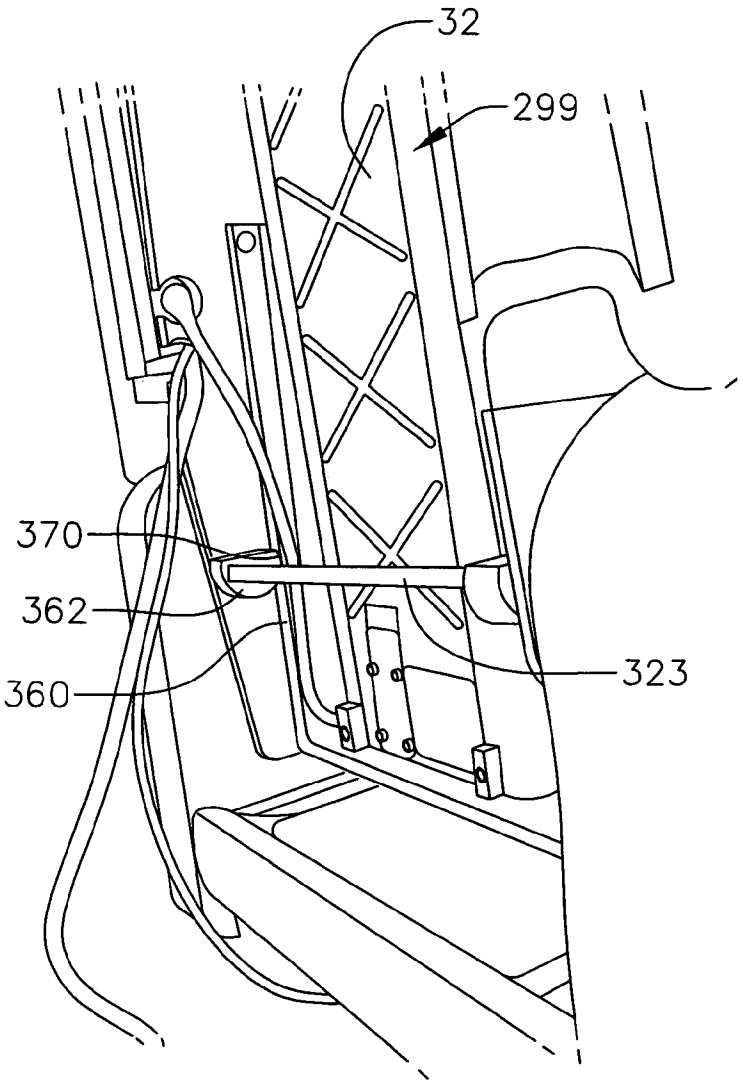
FIGS. 28A and 28B depict an exemplary adjustable massaging unit in retracted and deployed positions respectively.
Figure 28A:
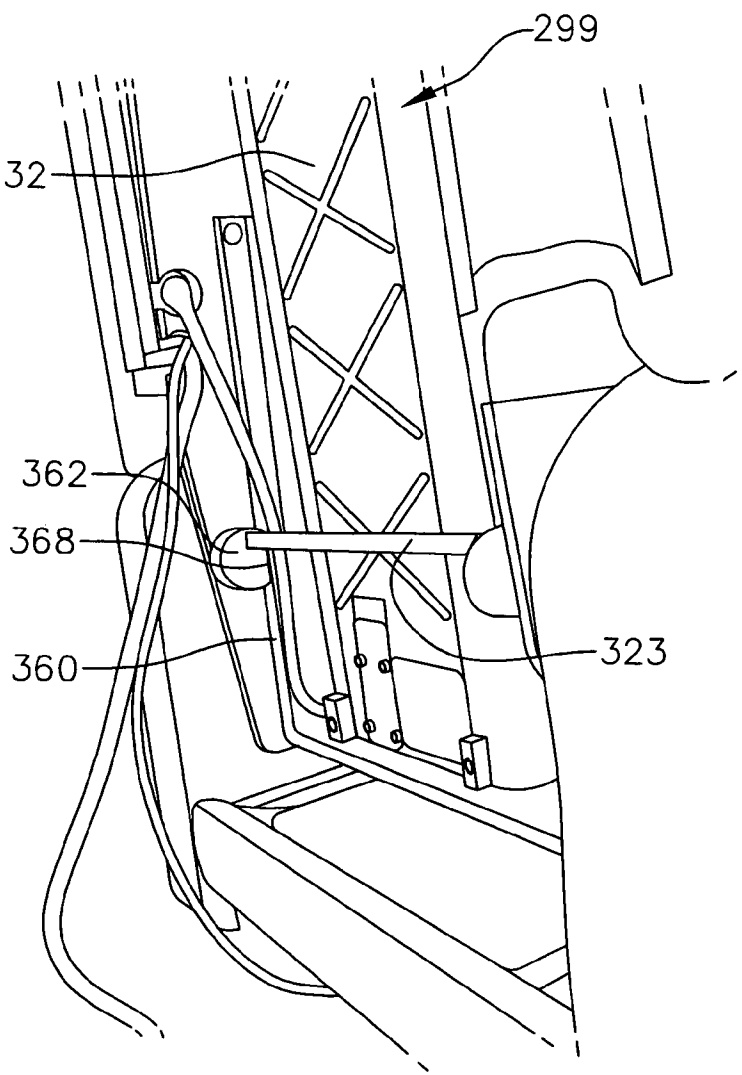

FIGS. 28A and 28B show support structure 32 of the adjustable massaging unit 299 in exemplary retracted and deployed positions, respectively. In the retracted position shown in FIG. 28A, flat surface 368 of irregularly shaped cam 362 contacts rear surface 360 of swing bracket 309. In this position, support structure 32 is positioned in closest proximity to cam shaft 323 and furthest away from the front of the chair and the massaging members are retracted from the massaging surface (not shown). In FIG. 28B in which the massaging unit is deployed for massaging use, oblong section 370 of cam 362 contacts rear surface 360 of swing bracket 309 deploying support structure 32 and the massaging unit forward with respect to the retracted position, and into massaging position. As cam shaft 323 and therefore cam 362 rotates, it can be seen that various other positions are achievable and that intermediate massaging positions are achievable depending on which portion of the irregularly shaped cams are rotated to be in contact with rear surface 360 swing of bracket 309.

Figure 29B:
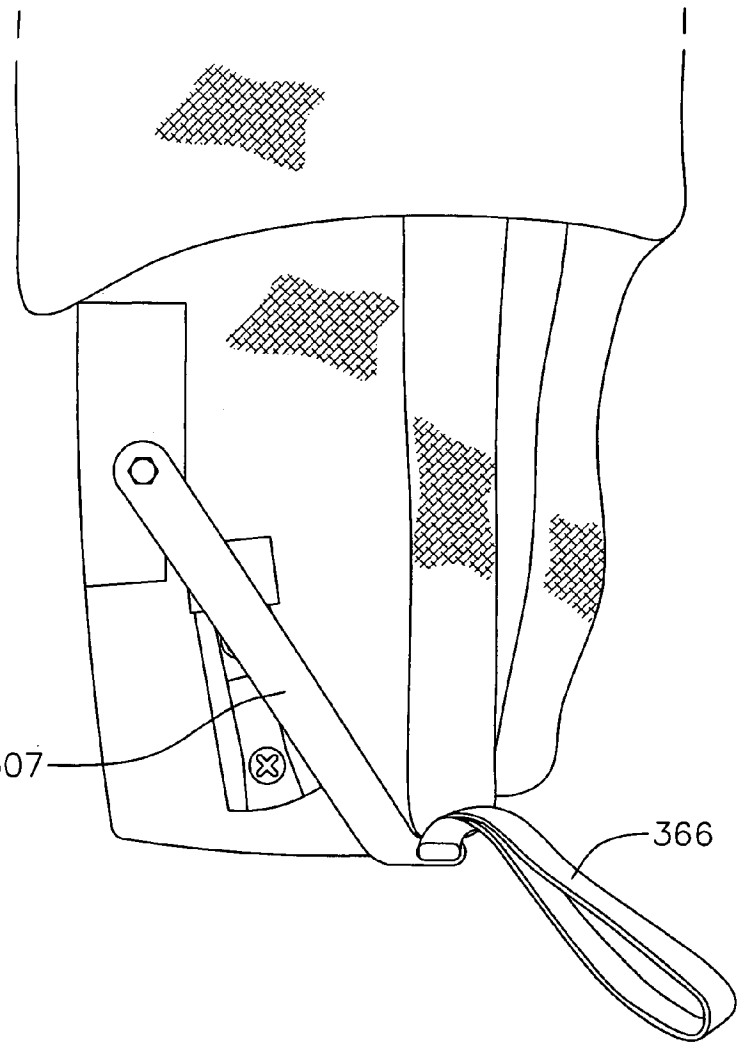
FIGS. 29A and 29B are side views illustrating two positions of an exemplary adjust handle used to adjust the adjustable massaging device; and, FIG. 30 is a front view of an exemplary adjust handle which extends along the back section of a chair.
Figure 29A:
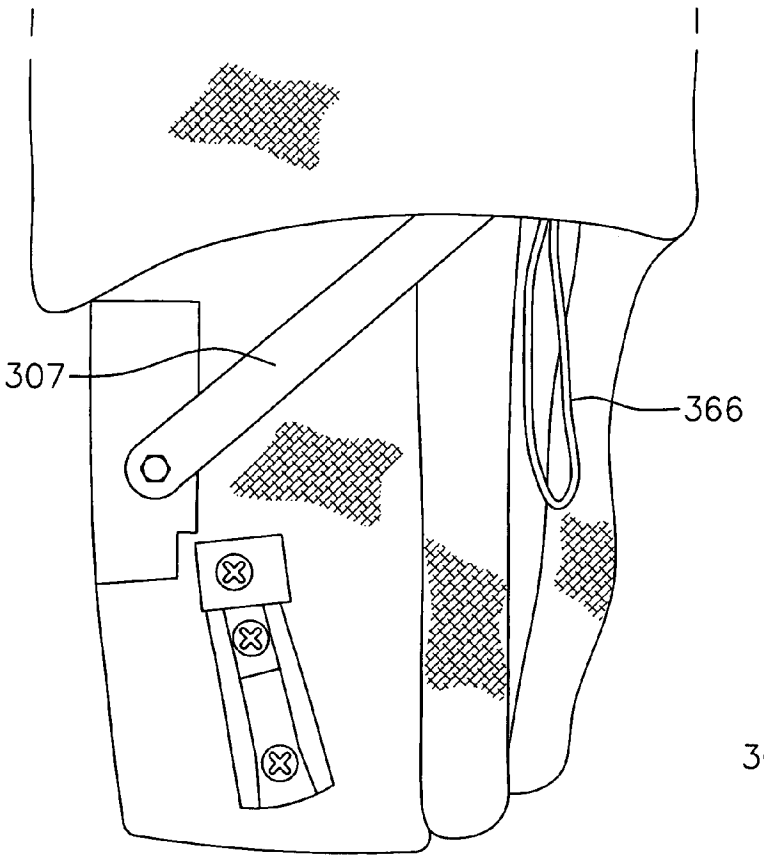

FIGS. 29A and 29B each show adjust handle 307 in a different position. Adjust handle 307 may be moved between positions thereby rotating the cam shaft and adjusting the massage mechanism. Adjust handle 307 includes strap 366.

Figure 30:
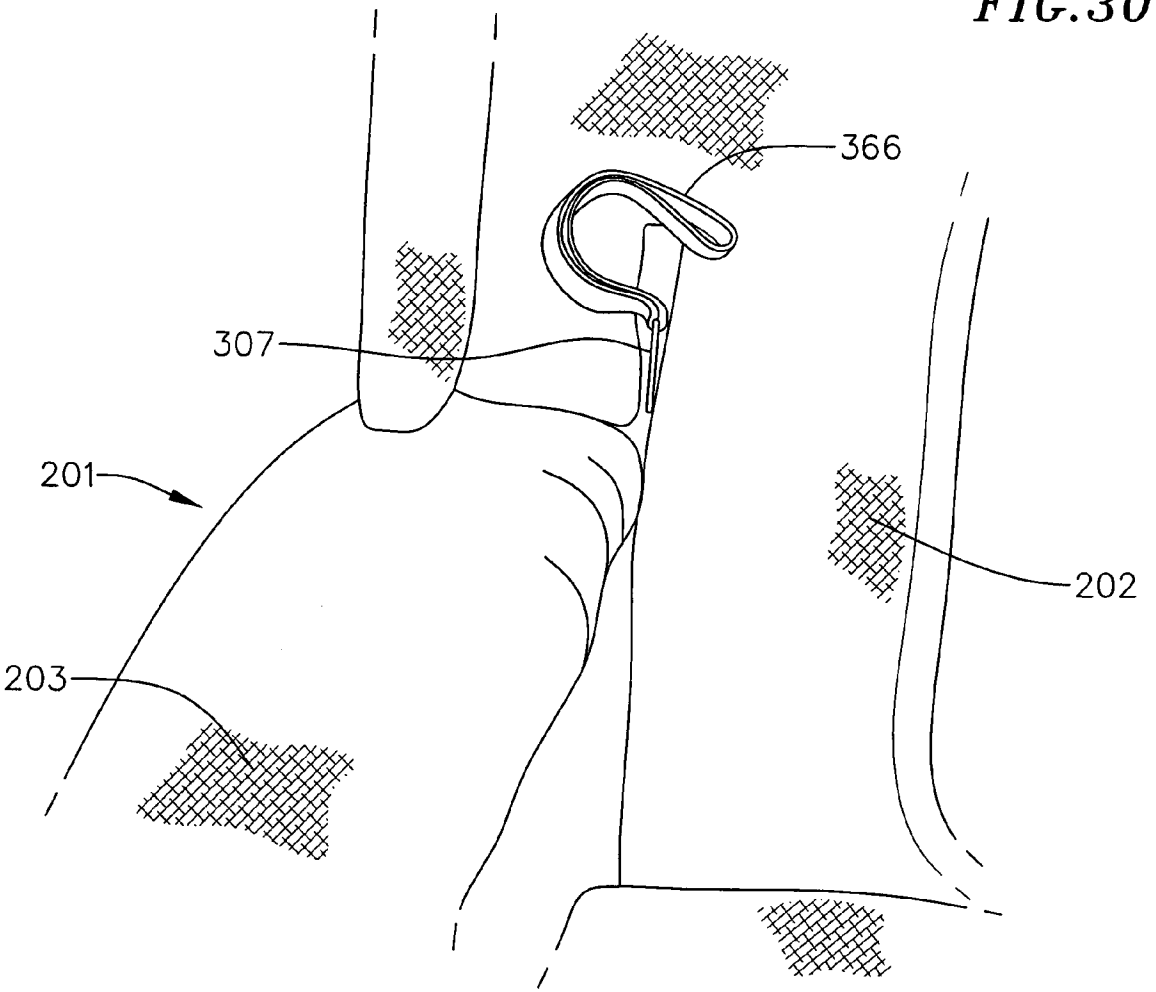

FIG. 30 is a front, perspective view showing back section 202 of chair 201. In this exemplary embodiment, adjust handle 307 and strap 366 extend alongside back section 202 on an inner portion of the chair and may be adjusted up and down within the seam formed between back section 202 and arm 203 of chair 201. In this manner, the user may adjust the massaging mechanism without reaching around to the exterior of chair 201.

It should be understood that the exemplary arrangements shown in the illustrated embodiments, are not intended to be limiting and that various alternative configurations of the elements shown, may be used. For example, the bracket may take on other shapes which accommodate the movement of the support structure. Additionally, various other methods may be used to cause the support structure to move with respect to the bracket and the massaging surface. For each embodiment, various deployed and retracted positions may be achieved. Various other locking mechanism may be provided to secure the support structure into any of various desired positions. The pivoting motion and position lock feature may be provided by other means and elements in other exemplary embodiments. For example, various gears, wires and belts, such as described above, may be used to move the support structure with respect to the bracket and to lock it into position.

It should be further understood that the pivoting motion as illustrated in the previous figures is intended to be exemplary only and that various other configurations and methods may be used so that the support structure on which the massage units of the adjustable massage device are disposed, is brought into and out of massaging position. According to the embodiment in which the support structure is hinged with respect to the bracket and moves obliquely with respect to the bracket, various other motorized and other mechanical means and methods may be used to provide such movement. According to another exemplary embodiment, the support structure may be displaced substantially perpendicular to the bracket and/or orthogonally with respect to the massaging surface. According to this exemplary embodiment, the plane of movement of the driving mechanism, along which the massaging member travels, is substantially parallel to the bracket and massaging surface both when in massaging position and when in fixed, retracted position. Various mechanical arrangements including various cams, links, rods, gears, pivots and other members, may be used to provide such movement. The present invention covers various other means and methods for causing the support structure and massaging members to move into and out of contact with the massaging surface.

It should be noted that the present invention has been described in many instances herein for purposes of description and illustrative clarity by referring to "left" and "right" components as for example the left massaging member or the right massaging member. Use of the terms "left" or "right", however, are not intended to limit the location of one component relative to another. For example, in an alternate massaging device embodiment, the locations of the components may be switched, i.e., the left components may be located at the right and visa versa. In other embodiments a "left" component may be to the right of a "right" component.

The various embodiments described above are provided by way of illustration only and should not be construed to limit the invention. Those skilled in the art will readily recognize various modifications and changes that may be made to the present invention without strictly following the example embodiments and applications illustrated and described herein, and without departing from the true spirit of the present invention, which is set forth in the following claims.

What is claimed is:

1. A massaging apparatus comprising:

a massage surface; and at least one massaging member moveable along a support structure, said support structure being moveable towards and away from said massage surface;

a guide rail affixed to a support structure, said guide rail including a first raceway having a generally V-shaped cross-section and said guide rail including a second opposing raceway spaced apart from said first raceway; and a carriage assembly including at least one rotatably attached guide wheel and at least one biasing member acting in opposition to said guide wheel, said guide wheel being adapted to travel within said first raceway, thereby coupling a carriage assembly to said guide rail, and said biasing member being adapted to bear against said second raceway, wherein force applied by said biasing member centers said guide wheel within said first raceway.

2. The massaging apparatus as in claim 1, in which said massaging apparatus includes an interior and an exterior, said massage surface forms an exterior surface of a massaging panel, and said support structure is disposed within said interior of said massaging apparatus and is capable of achieving at least one massage position in which said at least one massaging member contacts an opposed interior surface of said massaging panel, and at least one retracted position in which said at least one massaging member does not contact said massaging panel.

3. The massaging apparatus as in claim 1, in which said support structure is pivotally moveable towards and away from said massage surface.

4. The massaging apparatus as in claim 1, further comprising a bracket disposed in fixed position with respect to said massage surface and in which said support structure is coupled to said bracket and moveable with respect to said bracket.

5. The massaging apparatus as in claim 4, in which said bracket is generally planar and peripherally surrounds and is pivotally coupled to said support structure, and said support structure is obliquely moveable with respect to said bracket.

6. The massaging apparatus as in claim 4, in which said massaging apparatus includes an interior and an exterior and said bracket is disposed within said interior.

7. The massaging apparatus as in claim 1, in which said massage surface is included as the back part of a chair and is adapted for a user's back to rest against, and said support structure including said at least one massaging member, is disposed within said chair.

8. The massaging apparatus in claim 1, in which said massaging member is rotationally moveable along said support structure.

9. The massaging apparatus in claim 8, in which said massaging member is partially discoid in shape.

10. The massaging apparatus in claim 8, in which said massaging member is further capable of oscillatory motion.

11. The massaging apparatus in claim 1, in which said support structure includes a generally planar portion along which said at least one massaging member moves, and said support structure is pivotally moveable with respect to said massage surface.

12. The massaging apparatus in claim 1, in which said massage surface and said support structure are each oriented generally vertically, and said at least one massaging member moves vertically along said support structure.

13. The massaging apparatus in claim 12, in which said support structure includes a top and a bottom, said top being hingedly attached to said massaging apparatus and said bottom being moveable towards and away from said massaging surface.

14. The massaging apparatus in claim 1, further comprising a handle capable of moving said support structure to a plurality of positions.

15. The massaging apparatus in claim 14, further comprising a position lock for locking said handle into a plurality of handle positions corresponding to said plurality of positions of said support structure.

16. The massaging apparatus as in claim 1, wherein said support structure includes a generally planar portion along which said at least one massaging member is moveable.

17. A massaging apparatus comprising:

a chair including a back section having a receiving panel for a user's back to rest against;

a massaging member moveable along a support structure disposed within said back section, said support structure capable of moving with respect to said receiving panel and achieving a plurality of deployed positions in which said massaging member is in contact with an interior surface of said receiving panel and at least one retracted position in which said massaging member is not in contact with said receiving panel;

at least one guide rail affixed to the support structure, said guide rail including at least a first raceway;

a carriage assembly including at least one rotatably attached guide wheel, said guide wheel having a shaped surface being adapted to travel within said first raceway thereby coupling said carriage assembly to said guide rail said carriage assembly further including the massaging member; and a driving mechanism to translate the carriage assembly axially along said guide rails, the driving mechanism mounted on the carriage assembly, wherein said support structure is pivotally attached to said frame and capable of being positioned in a plurality of positions various distances from said receiving panel.

18. The massaging apparatus as in claim 17, in which said support structure is pivotally moveable within said back section.

19. The massaging apparatus as in claim 17, in which said support structure is coupled to a generally planar bracket which peripherally surrounds said support structure, and said support structure is pivotally moveable with respect to said bracket.

20. The massaging apparatus as in claim 19, in which said bracket is oriented generally vertically, and said support structure is hinged to said bracket near the top of said bracket, and is free to swing with respect to said bracket at the bottom of said bracket.

21. The massaging apparatus as in claim 17, wherein said chair comprises a recliner.

22. The massaging apparatus as in claim 19, in which said back section includes a frame therein and in which said bracket is integrally formed as a part of said frame and is composed of wood.

23. The massaging apparatus in claim 17, in which said support structure is oriented generally vertically and said massaging member is capable of motion along a vertical direction.

24. The massaging apparatus in claim 17, wherein the driving mechanism drives said guide wheel for translation along said at least one guide rail.

25. A massaging apparatus comprising a massaging device disposed within a back portion of a chair, including:

a chair having a back portion and a receiving panel for a user's back to rest against an exterior surface thereof;

a guide rail affixed to a support structure, said guide rail including a first raceway having a generally V-shaped cross-section and said guide rail including a second opposing raceway spaced apart from said first raceway, parallel to the plane of movement of a carriage assembly;

said carriage assembly including at least one rotatably attached guide wheel and at least one biasing member acting in opposition to said guide wheel, said guide wheel being adapted to travel within said first raceway, thereby coupling said carriage assembly to said guide rail, and said biasing member being adapted to bear against said second raceway, wherein force applied by said biasing member centers said guide wheel within said first raceway;

said carriage assembly further including a massaging member and means for driving said guide wheels, wherein said carriage assembly translates axially along said guide rails; and said support structure capable of being displaced towards and away from said receiving panel.

26. The massaging apparatus of claim 25, in which said support structure is coupled to a bracket fixed into position within said back portion and said support structure is capable of oblique movement with respect to said bracket.

27. The massaging apparatus of claim 25, in which said support structure is capable of achieving a first position in which said massaging member contacts an interior surface of said receiving panel and a second position in which said massaging member does not contact said interior surface of the receiving panel.

28. A chair-type massaging apparatus comprising a massaging device disposed within a portion of said apparatus, said massaging device including:

a frame attached within a back portion of a chair, said back portion including a receiving panel for a user's back to rest against an exterior surface thereof;

at least one guide rail affixed to a support structure, said guide rail including at least a first raceway;

a carriage assembly including at least one rotatably attached guide wheel, said guide wheel being adapted to travel within said first raceway thereby coupling said carriage assembly to said guide rail;

biasing means for biasing the roller against the raceway; and said carriage assembly further including a massaging member and means for driving said guide wheels, wherein said carriage assembly translates axially along said guide rails, wherein said support structure is pivotally attached to said frame and capable of being positioned in a plurality of positions various distances from said receiving panel.

* * * * *